US006817566B2

(12) United States Patent
Clifford et al.

(10) Patent No.: US 6,817,566 B2
(45) Date of Patent: Nov. 16, 2004

(54) WEB SPLICER

(75) Inventors: John W. Clifford, Ashland, MA (US); Andrew P. Butler, Marion, MA (US); Peter E. Bianchetto, Foxboro, MA (US); Pierre Gachet, Mouxy (FR); Robert Mavilia, Braintree, MA (US)

(73) Assignee: Butler Automatic, Inc., Middleborough, MA (US)

( * ) Notice: Subject to any disclaimer, the term of this patent is extended or adjusted under 35 U.S.C. 154(b) by 0 days.

(21) Appl. No.: 10/283,701

(22) Filed: Oct. 30, 2002

(65) Prior Publication Data

US 2004/0084561 A1 May 6, 2004

(51) Int. Cl.[7] ..... B65H 19/14

(52) U.S. Cl. ..... 242/552; 242/554.1; 242/554.2; 242/559.4; 242/598.2; 242/599.3; 156/564

(58) Field of Search ..... 242/552, 554.2, 242/554.1, 559.4, 564.5, 598.2, 599.3; 156/564

(56) References Cited

U.S. PATENT DOCUMENTS

| | | | | | |
|---|---|---|---|---|---|
| 3,305,189 | A | | 2/1967 | Butler, Jr., et al. | |
| 3,740,296 | A | * | 6/1973 | Mcdonald | 242/555.4 |
| 3,858,819 | A | | 1/1975 | Butler, Jr. | |
| 3,990,647 | A | | 11/1976 | Clifford | |
| 3,994,449 | A | | 11/1976 | Wales | |
| 4,015,794 | A | | 4/1977 | Meihofer | |
| 4,021,002 | A | | 5/1977 | Meihofer | |
| RE29,365 | E | | 8/1977 | Butler Jr. | |
| 4,190,475 | A | * | 2/1980 | Marschke | 156/157 |
| 4,392,912 | A | * | 7/1983 | Horsley | 156/504 |
| 4,473,430 | A | * | 9/1984 | Voltmer et al. | 156/350 |
| 4,575,016 | A | * | 3/1986 | Pali | 242/552 |
| 4,643,783 | A | * | 2/1987 | Hogenson | 156/64 |
| 4,738,739 | A | * | 4/1988 | Schoonderbeek | 156/159 |
| 5,042,272 | A | * | 8/1991 | Furr | 66/151 |
| 5,284,197 | A | * | 2/1994 | Cederholm et al. | 156/350 |
| 5,651,511 | A | * | 7/1997 | Crowley et al. | 242/420.3 |
| 5,716,022 | A | * | 2/1998 | Chiloff | 242/552 |
| 5,891,010 | A | * | 4/1999 | Kobben et al. | 493/478 |
| 6,595,463 | B2 | * | 7/2003 | Miyazaki | 242/598.2 |

* cited by examiner

*Primary Examiner*—Kathy Matecki
*Assistant Examiner*—Sang Kim
(74) *Attorney, Agent, or Firm*—Cesari and McKenna, LLP

(57) ABSTRACT

A web handling apparatus includes a base, a housing, a splicing head mounted in the housing, and first and second non-rotatable swing out roll shafts, each shaft having opposite first and second ends. The roll shafts are normally positioned in the housing substantially parallel to the splicing head so that web can travel through the splicing head to on from web rolls on the roll shafts. A web accumulator mounted to the housing conducts web to or from the splicing head and the housing is movably mounted to the base so that the housing can move relative to the base in either direction parallel to the roll shafts. An actuator connected between the housing and the base moves the housing relative to the base in response to signals from a web position sensor so as to minimize the side lay of web extending to or from the apparatus. The splicing head employs special mirror image upper and lower splicing sections which facilitate preparation of the leading end of the ready web while the other web is running and the two splicing sections cooperate to make a consistent high quality butt or lap splices between the two webs.

29 Claims, 18 Drawing Sheets

STEP ONE–UPPER ROLL READY TO SPLICE, WEB CLAMPED WITH HEAD CLOSED

STEP TWO-HEAD OPEN WITH WEB IN POSITION TO PREPARE SPLICE
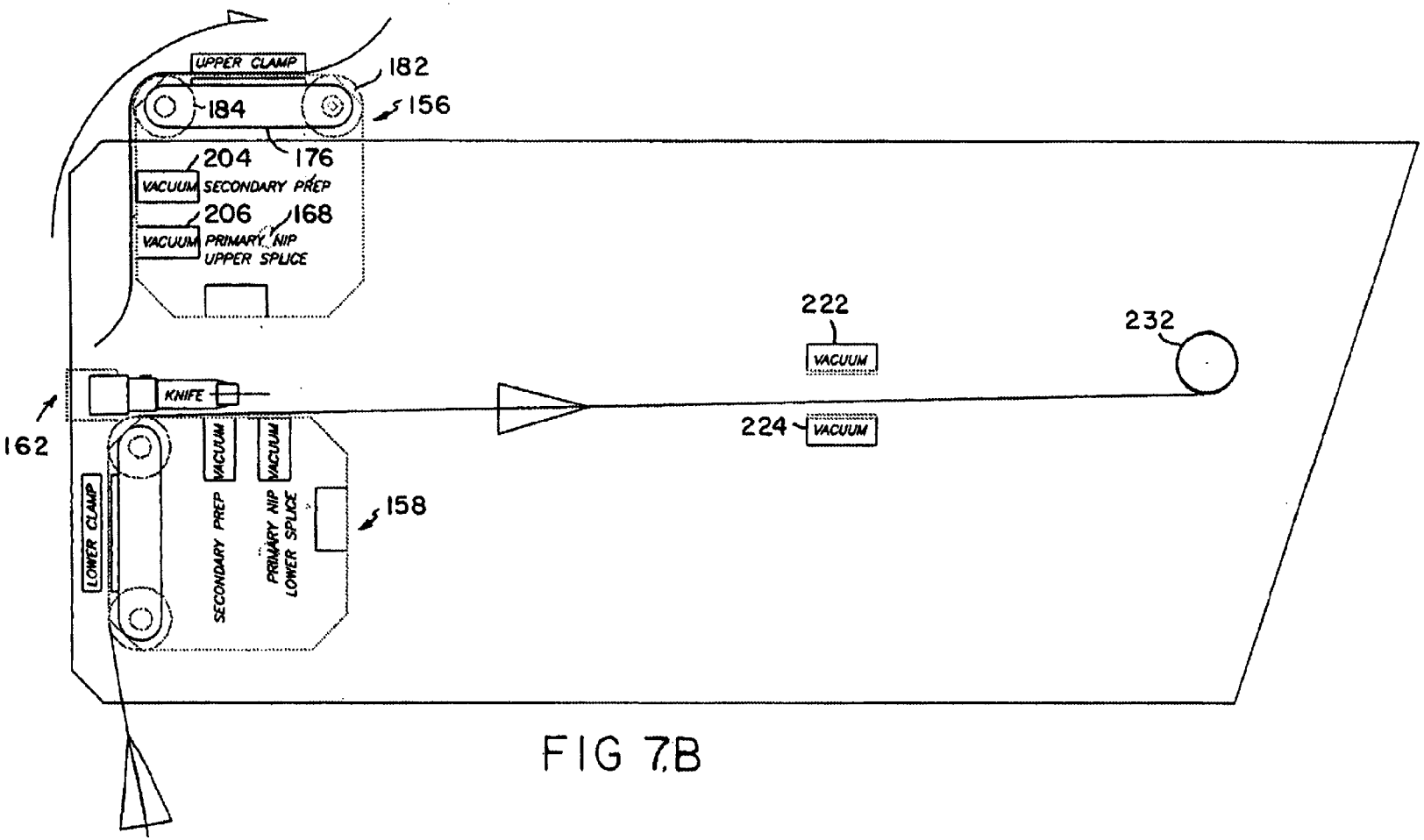
FIG 7.B

STEP FOUR–WEB REMOVED FROM SECONDARY PREP BAR AND TAPE PLACED ACROSS BOTH PREP BARS

STEP FIVE-WEB PLACED ON TAPE

STEP SIX–HEAD CLOSED, SLACK STORED DURING OPENING OF THE HEAD IS REMOVED BY CLOSING

STEP SEVEN–CLAMP OPENED, READY TO SPLICE

WEB SPLICER

RELATED APPLICATION

Not Applicable

BACKGROUND OF THE INVENTION

This invention relates to a web handling apparatus. It relates more particularly to a compact, user friendly web splicer which is particularly useful in but not limited to the packaging industry.

1. Field of the Invention

While we will describe the invention in the context of a zero speed splicer of the roll-over-roll type, certain aspects of the invention are equally applicable to other types of splicers including but not limited to roll-beside-roll and turret-style splicers and even to certain web winders.

The web splicers of interest here are well known in the art. Generally, these splicers have a running web roll and a ready web roll positioned one over the other. Web from the running roll is conducted through a splicing head into a web accumulator and then to web consuming apparatus, such as a bag making machine, which establishes the overall machine centerline. Typically, the web, which is often of a plastic material, travels into the web consuming machine at a moderate line speed of 50 to 350 ft/min. When the ready roll is about to expire, a splice sequence is initiated which decelerates and stops the running web at the splicing head, splices the already prepared leading end of the ready web to the now stationary running web and separates the spliced segment of the running web from its substantially empty roll core, following which the ready web is brought up to line speed. During this splice sequence, web is drawn from the accumulator to feed the web consuming machine so that there is no interruption in the web supply to that machine. After splicing, the accumulator is refilled with web from the ready roll and the empty roll is replaced with a fresh roll which then becomes the ready roll for the next splice sequence.

The various steps in the splice sequence may be carried out manually for splicers which handle moderate web speeds, as is the case here. In high-speed machines, those steps may be performed automatically. In any event, it is essential that the splicing operation take place in a reliable and consistent manner to avoid web breaks that could interrupt the web supply to the web-consuming machine.

2. Description of the Prior Art

The typical splicer used in the packaging industry is not particularly compact, efficient or user friendly. Many splicers have removable unwind shafts for supporting the rolls. In order to load a new roll into the splicer, a loose shaft must be threaded through bushings fitted in the ends of the roll core and the roll manually lifted up into the machine so that the unwind shaft seats in suitable fixtures therein. Thus when web is drawn from the roll, its core will rotate freely relative to the shaft.

When each new roll is inserted into the machine as aforesaid, it is not necessarily aligned with the machine centerline established by the downstream web-consuming machine. Therefore, conventional splicers invariably incorporate means for shifting the web roll in one direction or the other on its shaft (side lay adjustment) so that it is aligned with the machine centerline. Conventionally, this is accomplished by monitoring the lateral position of the web leaving the splicer using web edge sensors or the like and comparing that position with a desired centerline position in a feed back arrangement that controls an actuator able to adjust the side lay of a new roll in order to align the web from the new roll with that centerline.

The problem with this known procedure is that a large amount of web is stored in the splicer's accumulator. Therefore, if a new roll is not aligned with the machine centerline following a splice sequence, due to the length of web stored in the accumulator, there is a relatively long delay between the detection of the misalignment and the correction of the roll position on its shaft. This means that an appreciable length of misaligned web may be delivered to the web-consuming machine which could give rise to downstream problems resulting in web breakage. Bearing in mind that such misalignment can occur each time a new roll is loaded into the splicer, there is an appreciable potential for web wastage and machine downtime.

Conventional splicers used in the packaging industry have another drawback in that it is unnecessarily difficult to prepare the leading end of the ready web in preparation for a splice. This is because, as a rule, the region of the splicer where the splicing takes places, i.e., at the splicing head, is quite congested and the webs themselves are not presented in a way to facilitate the trimming of the leading edges of the ready webs and the application of the required splicing tapes. Accordingly, the splice preparation procedure takes longer than it should and there are often variances in the way that the splice preparation steps are carried out with the result that the quality of the resultant splices is not consistent. Obviously, a poor quality or defective splice can also cause web jams and web breakage in the downstream machine thereby reducing the throughput of that machine.

SUMMARY OF THE INVENTION

Accordingly, the present invention aims to provide a splicer which is especially suitable for use in the packaging industry, although not being limited to that application.

Another object of the invention is to provide a splicer of this type which is relatively compact and which has a small footprint.

A further object of the invention is to provide a zero speed splicer of the roll-over-roll type which facilitates the loading of fresh rolls into the splicer.

An additional object is to provide a splicer which has non-rotating roll shafts.

Another object is to provide such a splicer which minimizes the amount of misaligned web delivered to a downstream web-consuming machine following each splice.

Yet another object of the invention is to provide a web splicer of this general type which enables an operator to easily, efficiently and consistently prepare the webs that are to be spliced.

A further object of the invention is to provide a zero speed web splicer which produces high quality butt and lap splices between webs on a consistent basis.

Yet another object of the invention is to provide a splicer with the loading benefits of a cantilevered splicer and the space efficiency of a front-loading splicer.

An additional object is to provide a splicer able to easily make lap or butt splices with out modification of the splicing head.

A further object is to provide a zero speed splicer which utilizes a web roll surface drive instead of a traditional braking system.

Another object of the invention is to provide such a splicer with a roll surface drive which is used for web tension generation, stopping the web during splicing, roll acceleration after the splice and alignment of a running web's preprinted image with the image on a preprinted ready web.

A further objective is to provide a splicer with a roll surface drive which, when used in conjunction with a downstream web position sensor, identifies the last web segment on the expiring roll core, stops the running web and then backs up the web so as to rewind the web onto the core until the running web's preprinted image is aligned with the image on the ready web.

Other objects will, in part, be obvious and will, in part, appear hereinafter.

The invention accordingly comprises the feature of construction, combination of elements and arrangement of parts which will be exemplified in the following detailed description, and the scope of the invention will be indicated in the claims.

Briefly, the invention is implemented in a roll-over-roll splicer which splices at zero speed. However, as noted at the outset, certain aspects of the invention may be implemented in other types of splicers and even to some web winders.

The present splicer incorporates a conventional web accumulator so that web can be delivered uninterruptedly to a downstream web consuming machine of the type used in the packaging industry, e.g. a bag making machine. The two web rolls may be rotatably mounted to a pair of special swing-out unwind shafts normally positioned above and below and parallel to the splicing head. One end of each shaft is hinged to a side wall of the splicer so that the shaft can be swung out to an accessible loading position in front of the splicer where an operator can load a new roll fitted with end bushings into the splicer simply by sliding that roll endwise onto the shaft. Following that, the shaft and the new roll thereon may be swung to a closed operative position in preparation for the next splice.

In a preferred embodiment of the splicer, the upper unwind shaft is connected to the splicer side wall by way of a lifting device including a vertically movable carriage. When the upper shaft is in its open loading position, the carriage can be moved by suitable motive means (mechanical, pneumatic or hydraulic) between a lower loading position which places that shaft relatively close to the floor and an upper loading position which locates that shaft at its normal elevation above the splicing head. Thus by appropriately raising the carriage, an operator can load a new roll onto the upper unwind shaft quite easily and without any heavy lifting and so suffers minimal back and arm strain when loading a new roll into the splicer. Hence, the loading process is easier, safer and requires less exertion on the part of the operator.

Also as we shall see, the splicer incorporates a unique splicing head employing mirror-image upper and lower splicing sections for splicing the webs from the upper and lower rolls. When web from the lower roll is being delivered via the accumulator to the web consuming machine, the upper splicing section is used to prepare the leading edge of the web from the upper roll so that during the next splice sequence, that leading edge will be spliced to the trailing end of the web from the expired lower roll. Conversely, when web from the upper roll is being conducted to the web consuming machine, the lower splicing section is available to prepare the leading end of the web from the lower roll so that it can be spliced to the trailing end of the web from the upper roll during the following splice sequence. After each splice sequence or cycle, the unwind shaft supporting the empty roll is moved to its loading position and the roll core thereon is removed and replaced with a new roll following which that shaft is returned to its closed, operative position, and so on.

Preferably, to minimize the duration of the splice sequence and the amount of web that has to be stored in the accumulator, the splicer includes upper and lower roll surface drives each of which may accelerate a new or ready roll following a splice so that the web therefrom may be brought up to line speed in a minimum amount of time. Actually, the web is usually fed into the accumulator at a speed somewhat greater than line speed for a selected period of time to refill the accumulator to serve the needs of the web-consuming machine during the next splice sequence.

As we shall see, in the present splicer, instead of shifting a new roll on its shaft in order to align the web drawn therefrom with the machine centerline, the roll is set at a substantially fixed position along the shaft and the entire splicer including the accumulator is moved laterally relative to the machine centerline as necessary to align the new web with the machine centerline. More particularly, the splicer housing is moved laterally relative to a fixed base by an actuator that is connected in a feedback loop that responds to the output of a downstream web sensor that senses the side lay of the web leaving the splicer. This means that there is minimal delay between the detection of an off-center web and the correction of the side lay of the running web being drawn from the new web roll. Therefore, the amount of misaligned web following each splice sequence is minimized which, in turn, minimizes downstream problems involving the moving web.

Further as will be described in detail, the present splicer has a splicing head which gives the operator ready access to the leading end of the web from the ready roll, be it the upper roll or the lower roll, in order to prepare that end for splicing. Furthermore, the head is designed to splice the leading end of the ready web to the running web in a precise and consistent manner using either a butt splice or a lap splice. Therefore, there is minimal likelihood of the spliced-together webs parting during their travel from the splicer through the downstream web-consuming machine or causing jams or other problems in that machine.

All of the foregoing features combine to produce a web splicer which is optimized to suite the needs of the packaging industry.

BRIEF DESCRIPTION OF THE DRAWINGS

For a fuller understanding of the nature and objects of the invention, reference should be made to the following detailed description taken in connection with the accompanying drawings, in which:

FIGS. 7A to 7M are diagrammatic views illustrating the operation of the FIG. 6 splicing head.

DETAILED DESCRIPTION OF THE PREFERRED EMBODIMENTS

Figure 1:
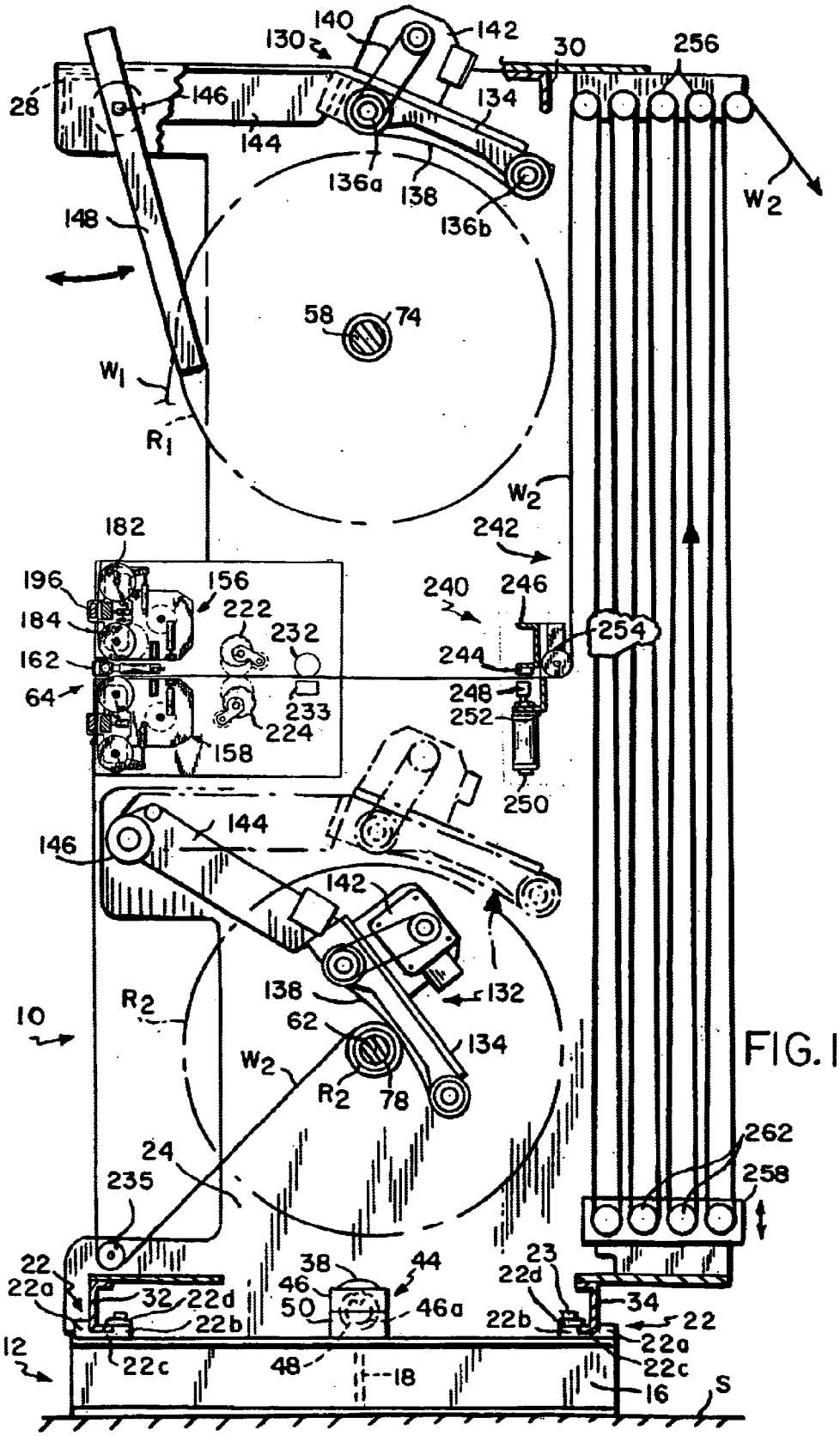
FIG. 1 is a left side elevational view, with parts broken away, of a splicer incorporating the invention.
Figure 2:
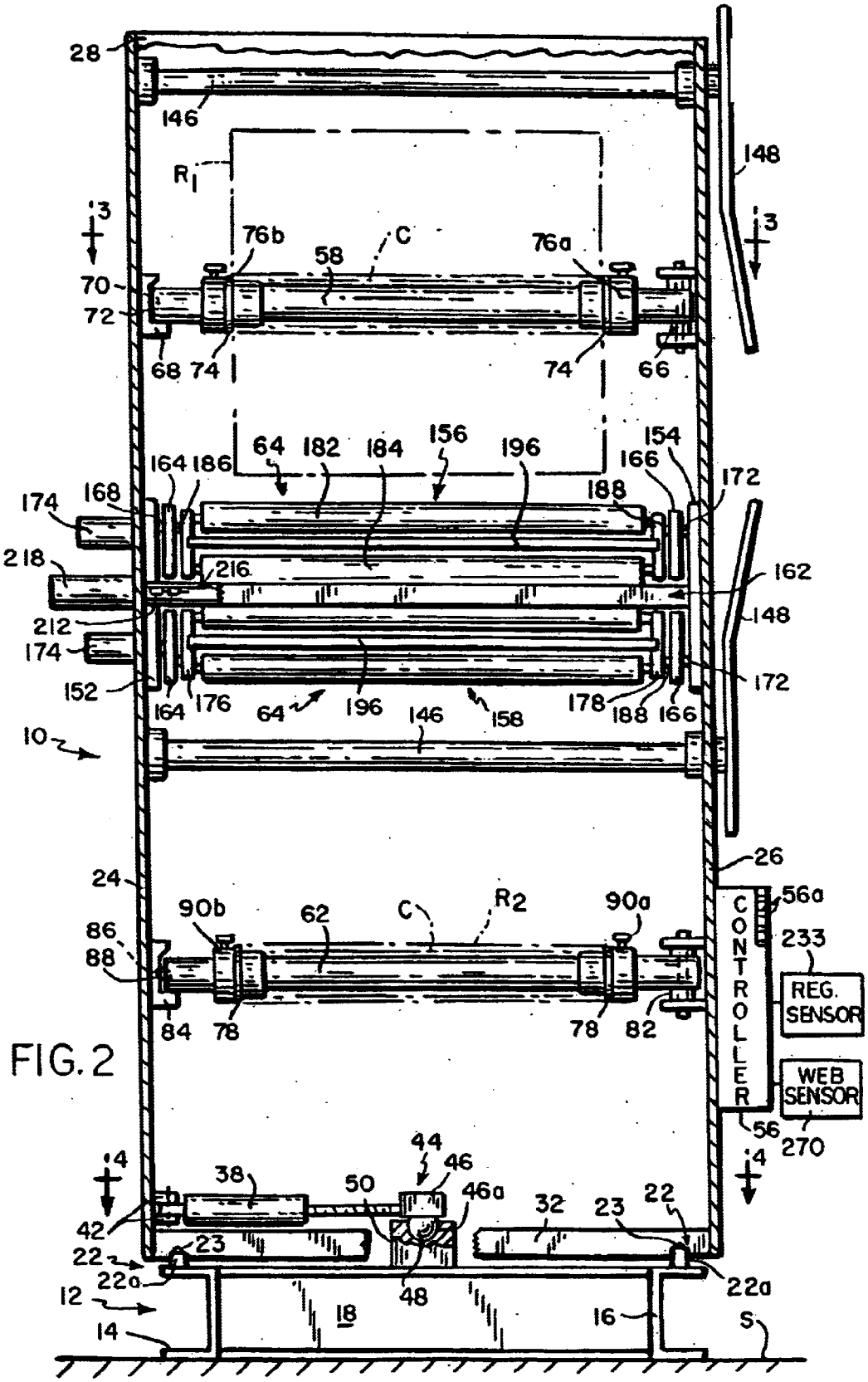
FIG. 2 is a front elevational view thereof.

Referring to FIGS. 1 and 2 of the drawings, the subject splicer comprises a frame or housing shown generally at 10 which is slidably supported on a base 12 firmly anchored to a support surface S. Base 12 includes a pair of side beams 14 and 16 which may be connected by one or more cross-beams 18. Mounted to the opposite ends of beams 14 and 16 are slides 22 secured by fasteners 23 or other means to beams 14 and 16. As will be seen presently, the slides 22, which are preferably of a strong, low coefficient of friction material, e.g. Delrin plastic, support the housing or frame 10 so as to permit the housing to be moved laterally relative to the base.

Housing 10 comprises a pair of spaced-apart side walls 24 and 26 whose upper ends are connected by front and rear frame members 28 and 30 in the form of angle irons and whose lower ends are connected by front and rear frame members 32 and 34. As best seen in FIG. 1, frame members 32 and 34 function as sliders for sliding in the slides 22 on base 12. That is, each slide 22 has a relatively high promontory 22*a* and a lower promontory 22*b* separated by a trough or channel 22*c*. The lower portion of each frame member 32, 34 is arranged to sit in the trough 22*c* of the underlying slide. When so seated, the lower promontory 22*b* of each slide extends up to the level of that portion of each frame member 32, 34. Those frame members are slidably secured to the corresponding slide by a slide cap 22*d* which seats on the rear promontory 22*b* so as to overhang the lower portion of the associated frame member 32 or 34. Each cap 22*d* may be secured to the remainder of the corresponding slide by one of the fasteners 23 that secure the slide to the beam 14 or 16.

Figure 4:
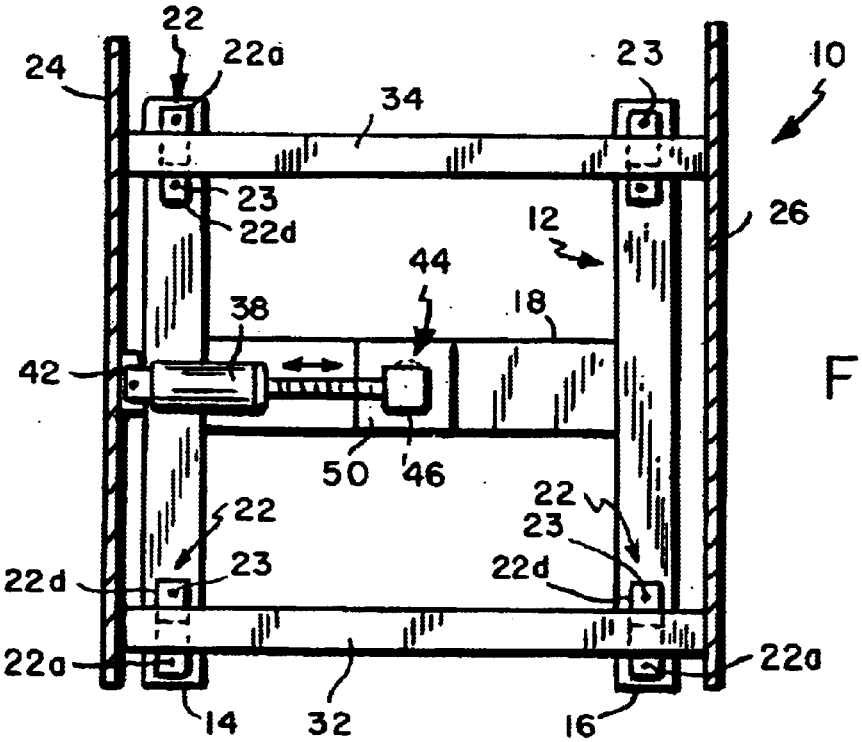
FIG. 4 is a similar view taken along line 4—4 FIG. 2.

Referring now to FIGS. 1, 2 and 4, the housing or frame 10 is moved laterally relative to base 12 by means of an actuator 38 pivotally connected at one end to ears 42 extending in from the side wall 24 of frame 10. The working end of the actuator may be connected by a universal joint 44 to a beam 18 of base 12. In the illustrated embodiment, the universal joint 44 is constituted by a block 46 rotatably connected to the working end of the actuator and which defines a ball 46*a* which seats in a socket 48 formed in a block 50 mounted to the top of beam 18. The actuator 38 may be any known type of mechanical, pneumatic or hydraulic actuator, the illustrated one being a lead screw-type actuator.

As will be described in more detail later, actuator 38 is controlled by a controller 56 (FIG. 2) having various control buttons 56*a* and which may be mounted to the side wall 26 of housing 10 or elsewhere on the apparatus.

Figure 3:
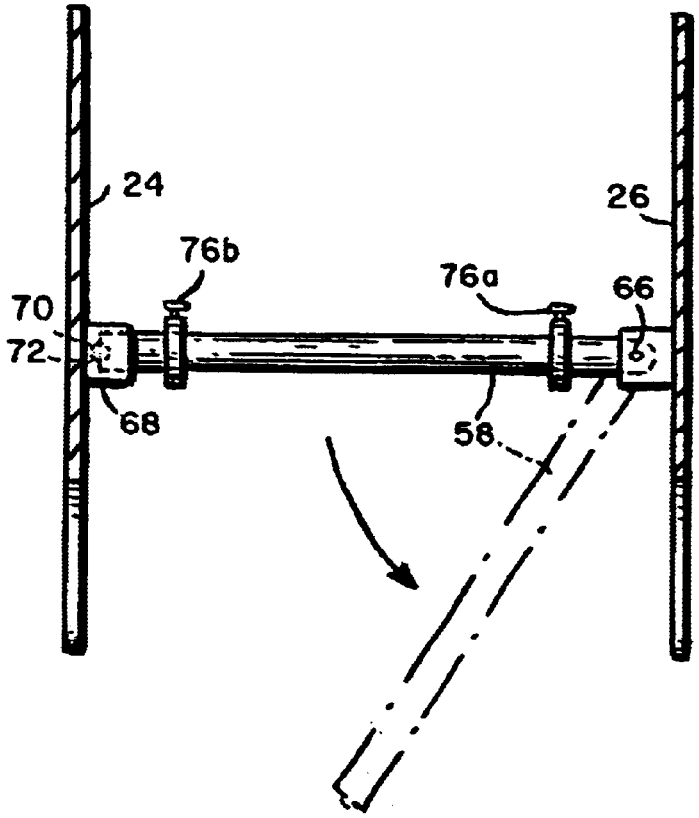
FIG. 3 is a sectional view on a smaller scale taken along line 3—3 of FIG. 2.

Referring to FIGS. 1 to 3, housing 10 contains similar upper and lower unwind shafts 58 and 62 positioned above and below a splicing head shown generally at 64. However, instead of being rotatable and/or removable from housing 10 as is usually the case, the shafts 58 and 62 are non-rotatable and swingable in and out of the housing. More particularly, one end of the upper shaft 58 is connected b a pivot 66 to the side wall 26 of housing 10 so that the shaft can by swung manually between a closed, operative position shown in solid lines in FIGS. 2 and 3 wherein the shaft is parallel to splicing head 64 and an open loading position shown in phantom in FIG. 3 wherein the shaft projects out in front of housing 10. When shaft 58 is swung to its closed position, its free end engages and seats on a saddle 68 mounted to housing side wall 24. Preferably, a spring-loaded ball 70 is installed in the free end of shaft 58 in position to engage a detent 72 in the saddle to releasably retain shaft 58 in its closed position.

As best seen in FIG. 2, shaft 58 is adapted to support a web roll $R_1$ having a roll core C preferably fitted with end bushings 74 of a suitable rigid plastic having a low coefficient of friction, e.g. Delrin plastic, enabling the web roll $R_1$ to rotate freely relative to shaft 58. Preferably also, the position of roll $R_1$ on shaft 58 may be set by a pair of stop members 76*a* and 76*b* which may be adjustably positioned along the shaft. To load a web roll on shaft 58, the shaft is swung to its loading position shown in phantom in FIG. 3. Then, after the stop 76*b* is removed from the shaft, a web roll is slid onto the shaft until stopped by the stop member 76*a*. After the stop 76*b* has been returned to the shaft to fix the position of the roll on the shaft, the shaft is swung to its closed, operative position shown in solid lines in FIGS. 2 and 3.

The lower unwind shaft 62 operates in exactly the same way to support a lower roll $R_2$ having a core C fitted with end bushings 78. That is, one end of shaft 62 is connected by a pivot 82 to the housing side wall 26 so that the shaft 62 can swing between open and closed positions. When the shaft is in its closed position, its free end engages and seats on a saddle 84 and that end is releasably retained in its saddle by a ball 86 in the end of the shaft which is biased toward a detent 88 in the saddle. Adjustable stop members 90*a* and 90*b* fix the position of the roll $R_2$ on shaft 62.

Figure 5B:
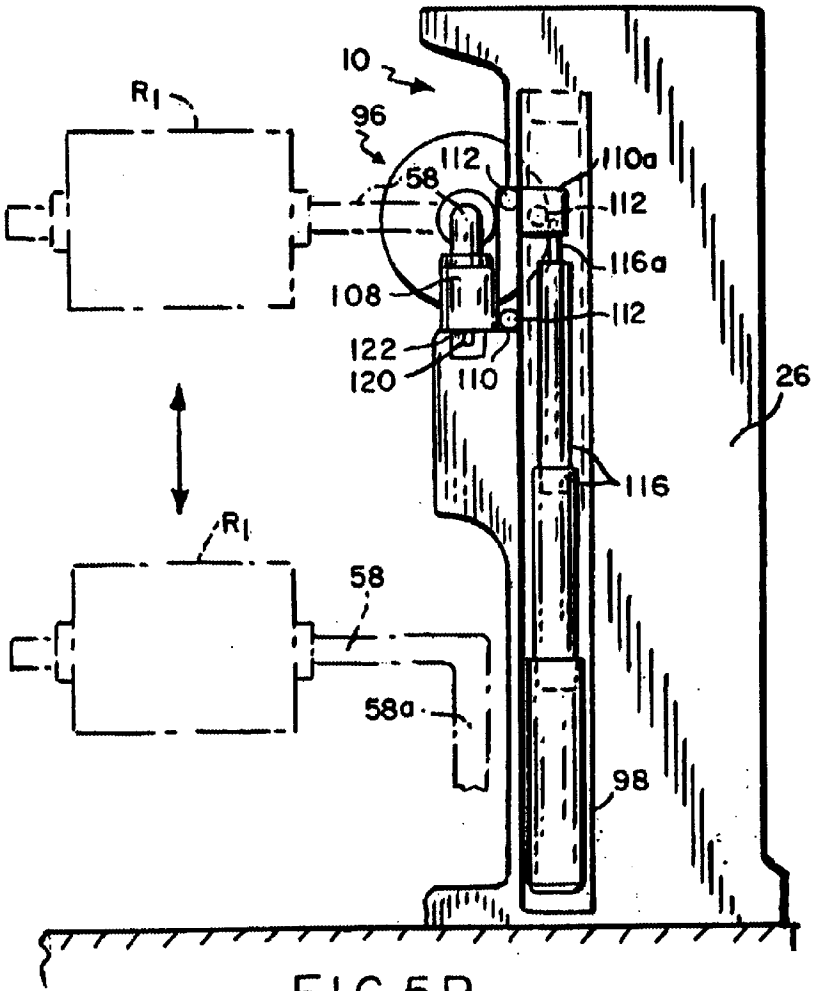
FIG. 5B is a left side elevational view thereof.
Figure 5A:
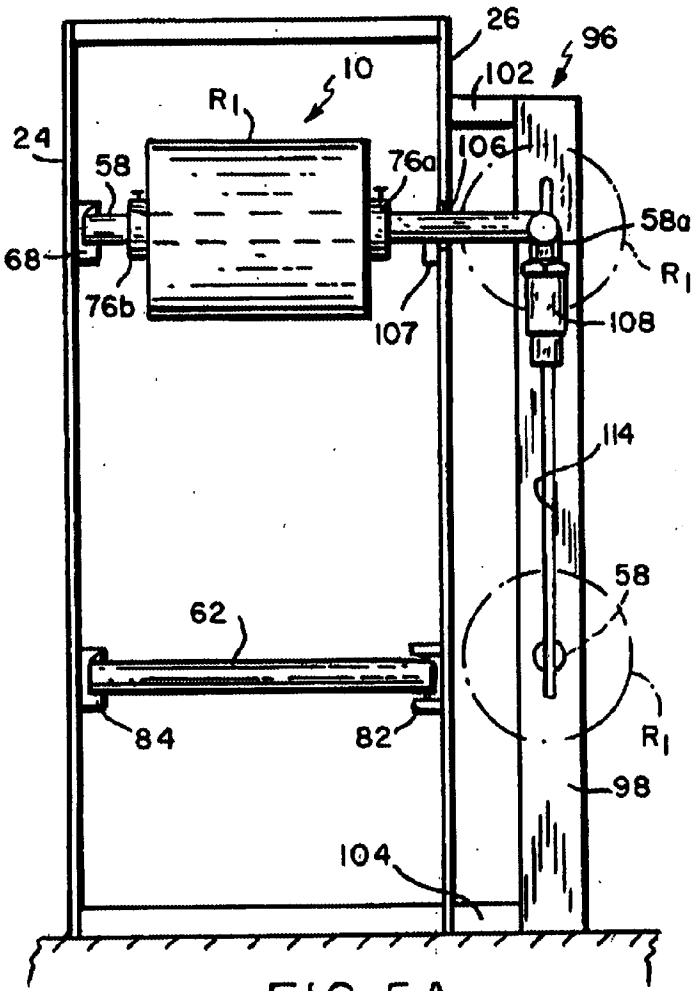
FIG. 5A is a front elevational view with parts removed of a splicer embodiment fitted with a roll lifting device.

Referring now to FIGS. 5A and 5B, a preferred embodiment of the splicer includes a roll handling or lifting device shown generally at 96 for automatically lifting a new or full web roll to the upper unwind shaft 58. The lifting device comprises a vertical tubular slide 98 which is connected by upper and lower brackets 102 and 104 to the outside surface of housing side wall 26 so that the slide extends up parallel to housing 10. Instead of pivotally connecting shaft 58 to side wall 26, the shaft extends through a slot 106 in that wall and is terminated by a downwardly extending arm 58*a* located in front of slide 98. Preferably, a shaft leveling support 107 projecting from shaft 58 adjacent slot 106 bears against wall 26 when the shaft is in its closed position to help support the shaft. Arm 58*a* is rotatably mounted in a pivot block 108 which is supported by a carriage 110 fitted with small wheels 112 which may roll up and down the front wall of slide 98. The carriage 110 has a portion 110*a* which projects through a slot 114 in the front wall of slide 98. That portion of carriage 110*a* is mounted to the working end 116*a* of a telescoping pneumatic lift cylinder 116 connected by suitable valving to a source of compressed air (not shown). The delivery of air to the lift cylinder 116 is controlled by controller 56 when the operator pushes one of the control buttons 56*a*.

In order to load a new roll on the upper shaft 58, the operator manually swings shaft 58 from its closed, operative position shown in solid lines in FIGS. 5A and 5B to the upper loading position shown in phantom in those figures such that the shaft projects directly out in front of housing 10. The operator then pushes a control button 56*a* on controller 56 to retract the lift cylinder 116 so that shaft 58 is lowered to the lower position shown in phantom in FIGS. 5A and 5B. After removing any empty roll core C and sliding a new roll onto shaft 58 as described above in connection with FIGS. 1 and 2, the operator may, by pushing a control button 56*a*, cause cylinder 116 to raise shaft 58 and roll thereon to the upper loading position shown in phantom in FIGS. 5A and 5B. The operator then manually swings shaft 58 to its closed, operative position shown in solid lines in those drawing figures. Preferably, an interlock is provided so that cylinder 116 is operative only when shaft 58 is in its open position. Although it may take any one of a number of conventional forms, the interlock is shown in FIG. 5B as being simply a micro-switch 120 mounted to the pivot block 108 and a pin 122 projecting from the shaft arm 58*a* which closes the micro-switch only when the shaft 58 is in its open (upper and lower) position shown in phantom in that figure.

Referring to FIG. 1, preferably the splicer includes web roll surface drives for accelerating a new web roll on each unwind shaft 58, 62 following a splice sequence and for controllably braking the web roll during normal operation of the splicer. Thus in the present splicer, an upper surface drive shown generally 130 is mounted between the housing side walls 24 and 26 above roll shaft 58 and a similar drive 132 is mounted between those walls above shaft 62. These drives 130, 132 are more or less conventional and their specifics are not part of the invention. Therefore, they will not be described in detail here. Suffice it to say that each drive includes a support 134 which rotatably supports a pair of spaced apart rollers 136*a* and 136*b* between which is stretched an endless belt 138, the lower stretch of which is adapted to contact the surface of the associated web roll $R_1$ or $R_2$. One of the rollers, e.g. roller 136*a*, is rotated via a belt 140 by a motor 142 mounted to support 134 and controlled by controller 56. Each support 134 is connected by way of brackets 144 to a shaft 146 whose opposite ends are journalled in the housing side walls 24 and 26. Using a handle 148 connected to one end of shaft 146, each accelerator 130, 132 may be moved between an operative position wherein belt 138 engages the surface of the underlying roll $R_1$ or $R_2$ and a raised inoperative position wherein the accelerator is lifted out of contact with the associated roll. In FIG. 1, the lower accelerator 132 is shown in solid lines in its operative position and in phantom in its raised, disengaged position. Latches, not shown, may be provided to releasably retain each accelerator 130, 132 in its raised, disengaged position.

Figure 6:
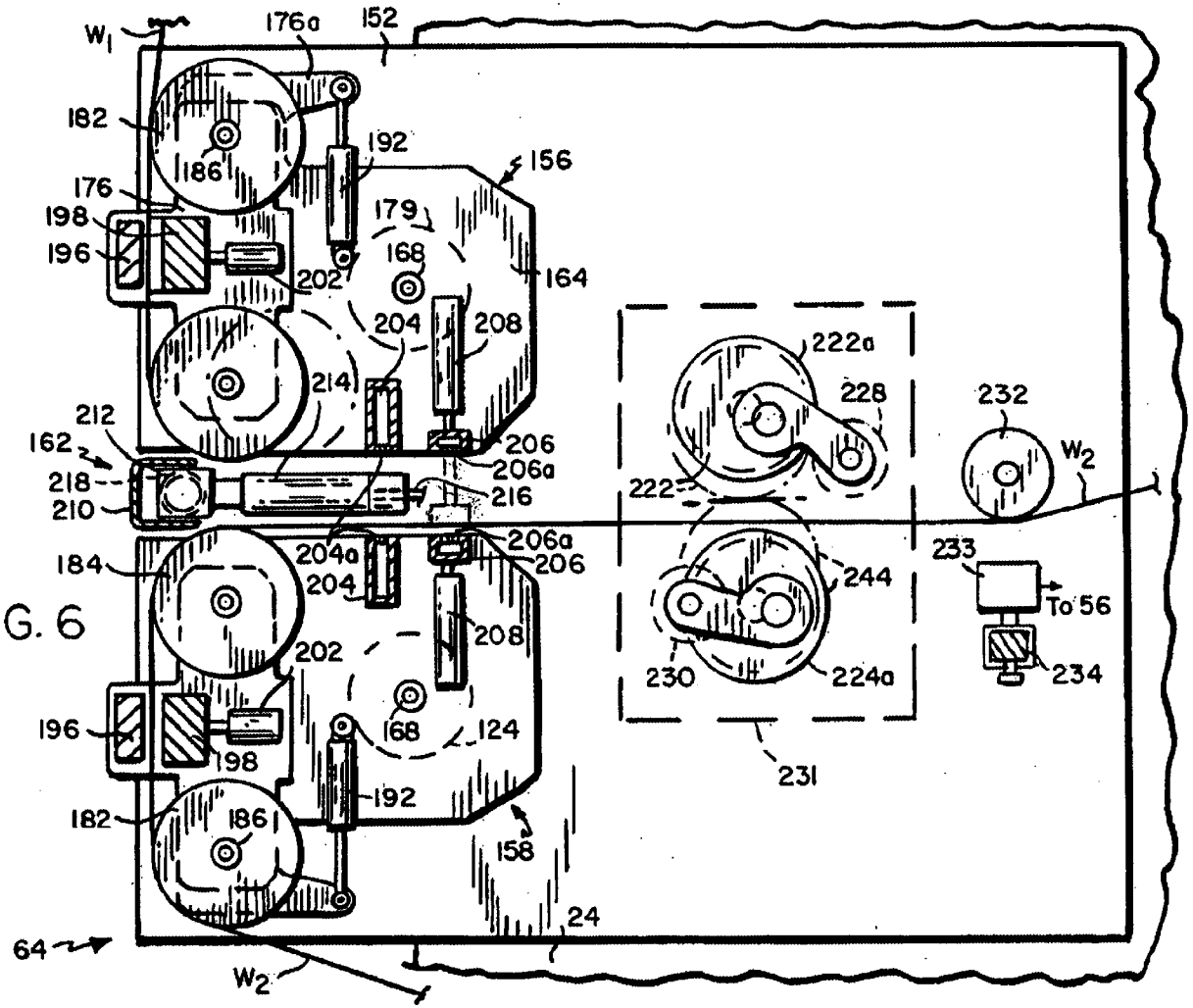
FIG. 6 is a left side elevational view on a larger scale and with parts removed showing the splicing head of the FIG. 1 splicer.

Referring to FIGS. 1, 2 and 6, the splicing head 64 comprises a pair of opposite side plates 152 and 154 which are releasably mounted to the housing side walls 24 and 26, respectively, so that if necessary, e.g. for repair, the entire head 64 may be removed from housing 10. Pivotally mounted between the side plates 152 and 154 is a pair of mirror image, upper and lower splicing sections 156 and 158 and positioned between those splicing sections is a traveling knife assembly shown generally 162.

The upper splicing section 156 comprises a pair of side plates 164 and 166 having shafts 168 and 172 rotatably mounted to plates 152 and 154, respectively. Shafts 168 and 172 could just as well be a common shaft journalled in end plates 152 and 154. The splicing section 156 is rotatable relative to side plates 152 and 154 between a normal operative position shown in FIGS. 6 and 7A and an open web preparation position shown in FIG. 7B. While the splicing section may be rotated manually between its two positions, in the illustrated splicer, it is rotated by a reversible rotary actuator 174 mounted to side wall 24 which rotates shaft 168 approximately 90° in one direction or the other when commanded by controller 56.

Splicer section 156 also includes a pair of vertical brackets 176 and 178 located inboard side plates 164 and 166, respectively, adjacent to the forward edges thereof. Rotatably mounted between these brackets are upper and lower rollers 182 and 184. The brackets 176 and 178 are connected to the adjacent plates 164 and 166 by pivots 186 and 188, respectively. These pivots allow the brackets 176 and 178 to be swung so as to move the lower roller 184 between a first position shown in solid lines in FIG. 6 and a second position shown in phantom for reasons that will become apparent. The brackets are moved between their two positions by a pair of pneumatic cylinders 192 each acting between a side plate 164 or 166 and a lever arm 176*a* extending from the associated bracket 176 or 178. The cylinders 192 swing the brackets 176, 178 between their two positions under the control of controller 56.

Still referring to FIG. 6, the brackets 176 and 178 may also support an elongated anvil 196 located between and in front of rollers 182 and 184. In that event, an elongated clamping bar 198 is spaced behind the anvil and may be moved toward and away from anvil 196 by pneumatic cylinders 202 mounted to brackets 176 and 178 and controlled by controller 56. The clamping bar 198 may be moved between a retracted position shown in solid lines in FIG. 6 wherein the clamping bar is spaced away from the anvil 196 and an extended position shown in phantom in which the clamping bar exerts pressure on the anvil.

The splicing section 156 also includes an elongated web preparation bar 204 which is supported between plates 164 and 166 adjacent to the lower edges of those plates. Preferably, the preparation bar 204 is hollow and has a lower working surface 204*a* formed with a multiplicity of small holes. Bar 204 is connected to a vacuum source (not shown) controlled by controller 56 so that a vacuum may be present at surface 204*a* at appropriate times as will be described later.

The splicing section 156 also contains a splicing bar 206 which extends between the plates 164 and 166 behind the preparation bar 204. Bar 206 is preferably also a vacuum bar which has a perforate working surface 206*a* which faces downwards and is in the same plane as the surface 204*a* of the preparation bar 204. The splicing bar 206 may be moved by pneumatic cylinders 208 mounted to side plates 164 and 166, under the control of controller 56, between a retracted position shown in solid lines in FIG. 6 and an extended position shown in phantom in that same figure wherein the surface 206*a* of nip bar 206 exerts pressure against the corresponding bar of the lower splicing section 158 while the latter bar is retracted as shown in FIG. 6.

As stated above, the splicing section 158 is a mirror image of section 156 and accordingly has the same parts described above which, therefore, are assigned the same identifying numerals for convenience.

Still referring to FIG. 6, the knife assembly 162 comprises a channel-like slide 210 which extends between, and is supported by, the side plates 152 and 154 of the splicing head 64. Slidable along slide 210 is a slider or shuttle 212 to which is connected a carriage 214 that supports two oppositely facing knife blades 216 at a location just in front of the splicing bars 206 of the two splicing sections 156 and 158. Preferably, each knife blade 216 has a V-shaped cutting edge. The slider 212 may repose in a home position at either side of the splicing head in which the blades 216 are retracted out of the way of the web paths through the splicing head 64; see FIG. 2. The slider may be moved along the length of slide 210 in either direction under the control of controller 56 by a telescoping pneumatic cylinder 218 mounted to the housing side wall 24 which drives the slider from one side of splicer head 64 to the other. Thus the knife assembly 162 will cut web from either web roll $R_1$ or $R_2$ when the shuttle 212 is moved in either direction along slide 210.

Still referring to FIG. 6, the splicing head 64 also includes upper and lower elongated nip rollers 222 and 224 located behind the splicing sections 156, 158 and which extend between plates 152 and 154 above and below the longitude center line of the splicing head 64. Preferably, the nip rollers 222 and 224 are hollow and have perforate working surfaces 222*a* and 224*a*, respectively. The nip rollers are connected to a vacuum source which operates under the control of controller 56 so that a vacuum can be drawn at surface 222*a* or 224*a* at selected times. The upper nip roller 222 may be moved by rotary actuators 228 acting between the side plates 152 and 154 and the opposite ends of the roller under the control of controller 56 between a retracted position shown in solid lines in FIG. 6 and an extended position shown in phantom there.

Likewise, the lower nip roller 224 may be moved by similar rotary actuators 230 between a retracted position shown in solid lines in FIG. 6 and an extended position shown in phantom. When the two nip rollers 222 and 224 are in their extended positions, they exert pressure on one another. As will be described, a second strip of tape may be deposited on one or the other of these rollers to produce a two-sided splice. To facilitate the application of tapes to these rollers, they may comprise a separate nip unit that may be slid laterally out of the splicer housing 10 as indicated by dotted lines at 231 in FIG. 6.

Preferably, an elongated idler 232 is rotatably mounted between plates 152 and 154 behind the nip rollers 222, 224 to control the direction of the running web as it leaves the splicing head and a registration sensor 233 is adjustably mounted to a horizontal bar 234 supported by the side plates 152 and 154. Sensor 233 is arranged to sense indicia printed on the undersides of some webs and to deliver a registration signal to controller 56 (FIG. 2) as will be described later.

Referring to FIGS. 1 and 6, web $W_1$ from the upper roll $R_1$ conducted down to the splicing section 156, passing in front of roller 182 and between the anvil 196 and the clamping bar 198 of that splicing section. Thence, the web passes around roller 184 and between the nip rollers 222 and 224 and under idler roller 232. In a similar manner, the web $W_2$ from the lower web roll $R_2$, after passing under an idler roller 235 (FIG. 1), at the bottom of housing 10, travels up in front of the roller 182 of the lower splicing section 158, and around roller 184 thereof and thence between the nip rollers 222 and 224 and under roller 232 out of the splicing head.

As best seen in FIG. 1, whichever web $W_1$ or $W_2$ is the running web, that web is conducted from the splicing head 64 through a nip assembly shown generally at 240 and into a web accumulator shown generally at 242 mounted directly to the back of housing 10. The web leaving the accumulator is drawn into a web consuming machine (not shown) downstream from the splicer and is desirably aligned with the centerline of that machine.

The nip assembly 240 includes an elongated anvil 244 located just above the web path into the accumulator. The anvil is longer than the length of the web rolls $R_1$ and $R_2$ so that it can be supported at its opposite ends by brackets 246 projecting in from the housing side walls 24 and 26. Spaced below anvil 244 is an elongated nip bar 248 which may be moved toward and away from the anvil 244 by a pair of pneumatic cylinders 250 mounted to brackets 252 extending in from side walls 24 and 26 of housing 10. As will be described later, the pneumatic cylinders 250 are actuated under the control of controller 56 so as to clamp the running web at a selected time in the splice sequence to prevent web from being drawn backwards out of the accumulator 242 during a splice sequence.

The final component of the nip assembly 240 an idler roller 254 supported by frame members 24 and 26 which redirects the web leaving assembly 240 into the accumulator 242.

The accumulator 242 may be a conventional one and will not be described in detail here. Suffice to say that it has a fixed set of rollers 256 at the top of housing 10 and a lower dancer 258 which supports a second set of rollers 262. The dancer is movable vertically toward and away from rollers 256. The dancer is biased downwardly by gravity or other means and the running web is looped around the rollers 256 and 262 as shown so that a substantial length of web can be stored in the accumulator. Thus when a splice sequence is being carried out by the splicer, the accumulator 242 can supply the requirements of the downstream web consuming machine so that that machine receives web continuously from either the upper or lower roll of splicer 10. The accumulator also helps to minimize tension upsets in the running web during normal operation of the product line.

In describing the operation of the splicer, we will assume that the lower surface drive 132 is in engagement with roll $W_2$ and that the downstream web consuming machine is drawing web $W_2$ from the lower roll $R_2$ as shown in FIG. 1 and that a new roll $R_1$ has been loaded onto the upper shaft 58 as described above, preferably using the lifting device 96 depicted in FIGS. 5A and 5B, the upper surface drive 130 having been latched in its raised disengaged position as shown.

As is well known in the art, the web consuming machine draws web $W_2$ at a substantially constant speed and the accumulator dancer 258 moves up and down in response to tension changes in the web. The position of the dancer may be sensed and used to provide a feedback signal via controller 56 to the device 132 (or 130) to control the speed of roll $R_2$ (or $R_1$) as necessary to keep the accumulator full of web and to maintain substantially constant tension in the web.

In accordance with the invention, the lateral position of the running web $W_2$ is monitored by a web sensor 270 indicated in FIG. 2, which may be a photocell, edge sensor or the like, connected electrically to controller 56. The controller compares the position of the running web with the desired position established by the downstream machine to develop a feedback signal for controlling actuator 38 described above which moves housing 10. In response to that signal, the actuator shifts the entire splicer housing 10, including the accumulator 242, laterally in one direction or the other as needed to minimize the deviation of the running web center line from the downstream machine center line.

Figure 7A:
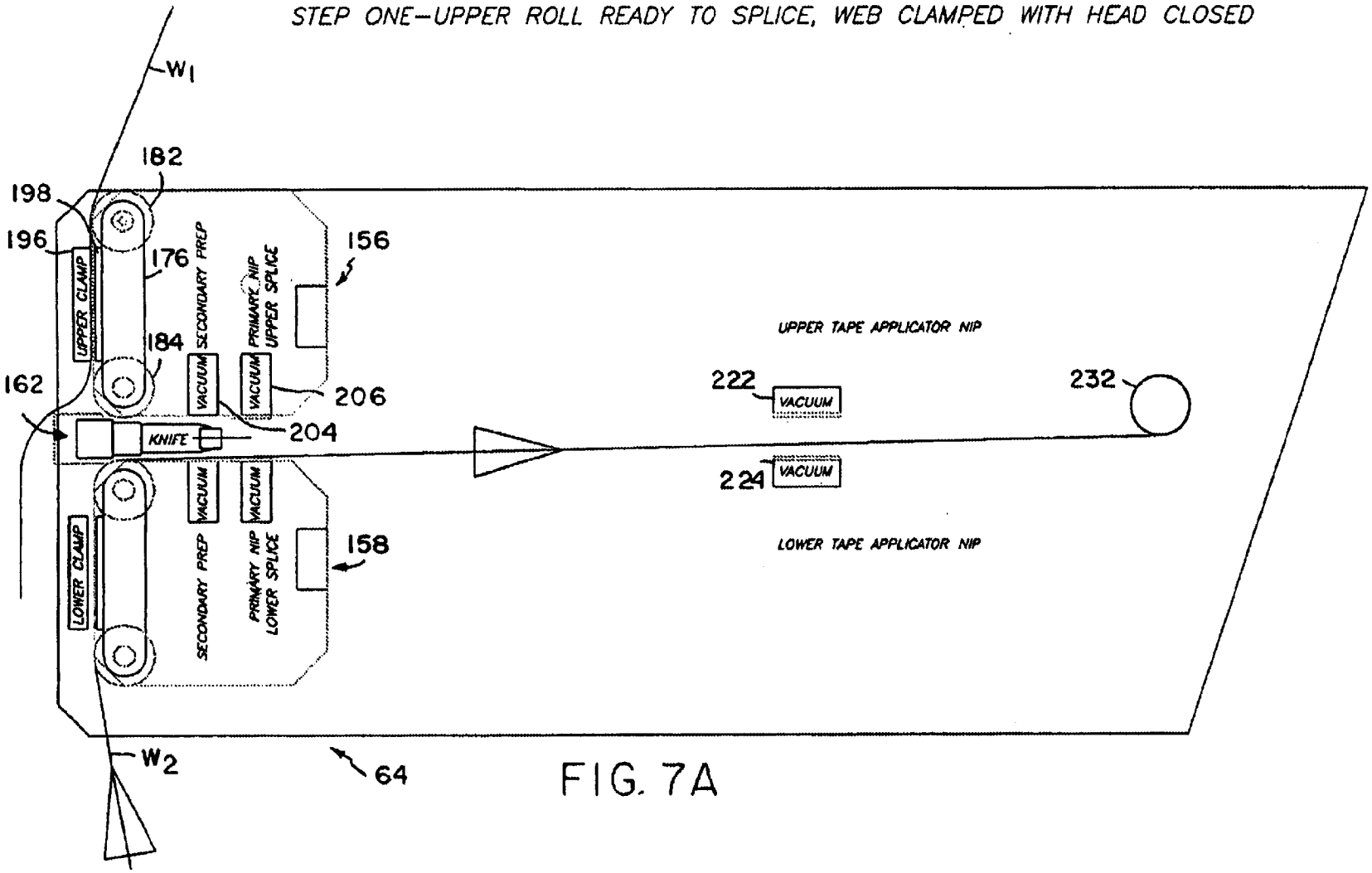
Figure 7C:
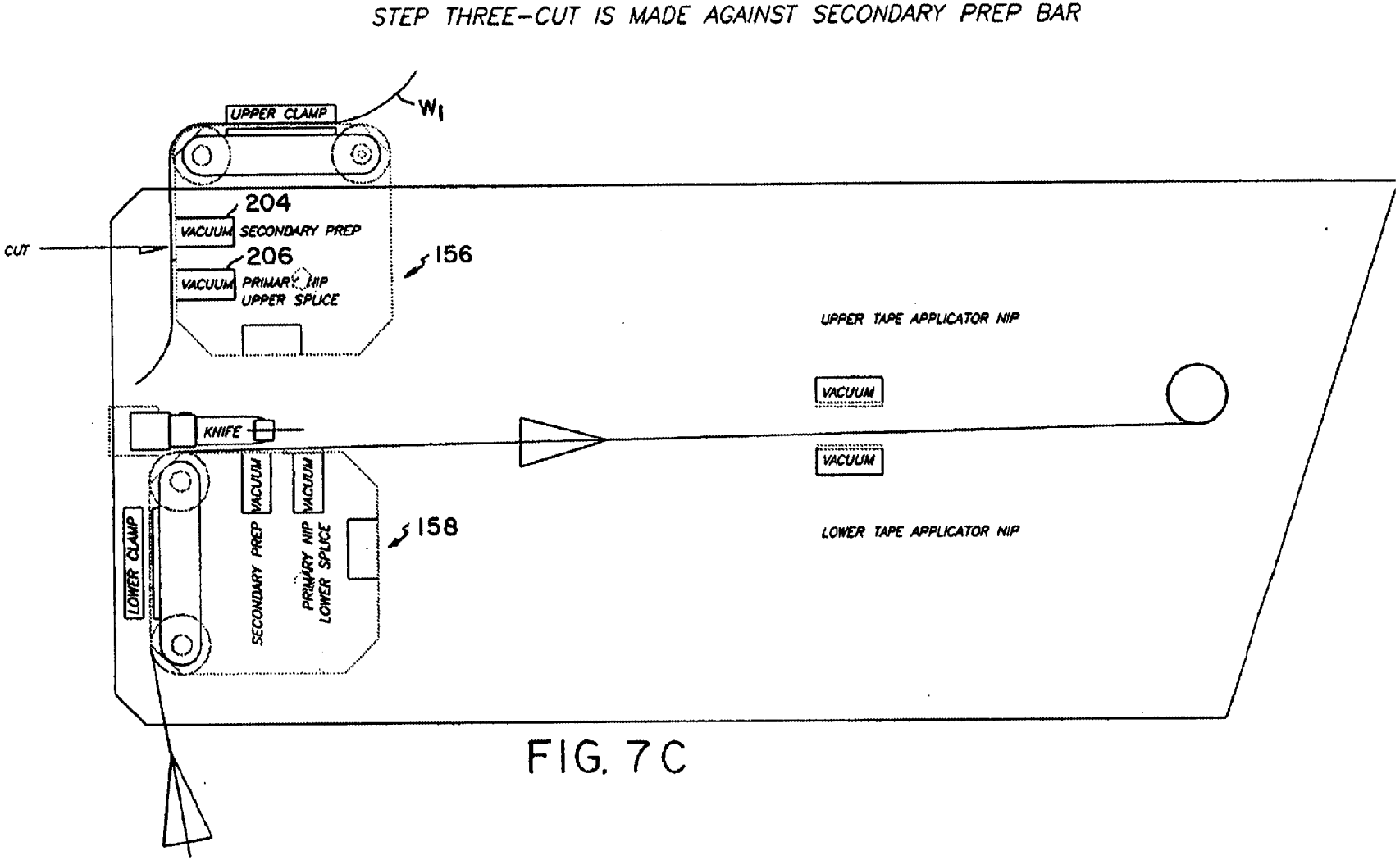
Figure 7D:
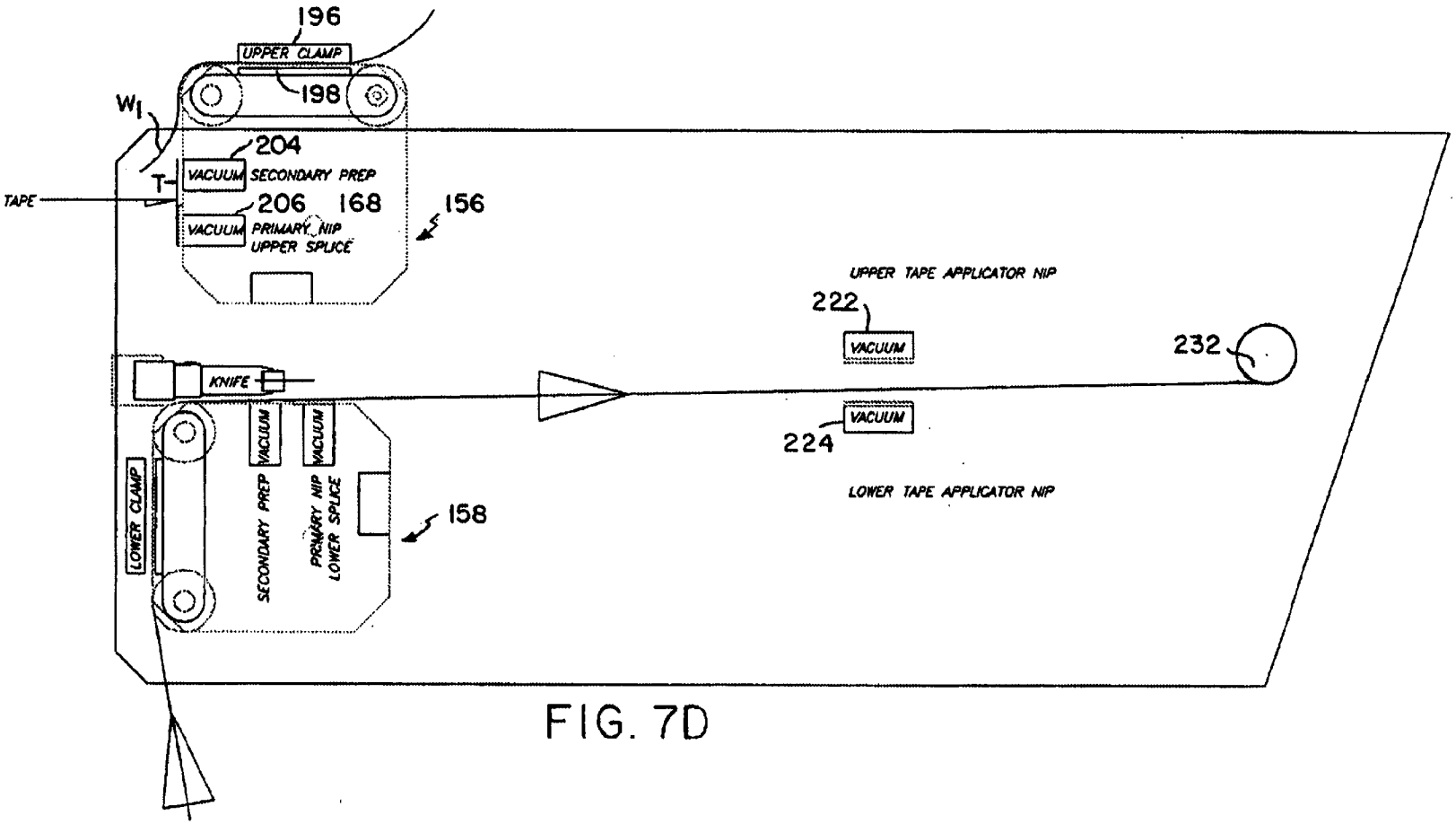
Figure 7E:
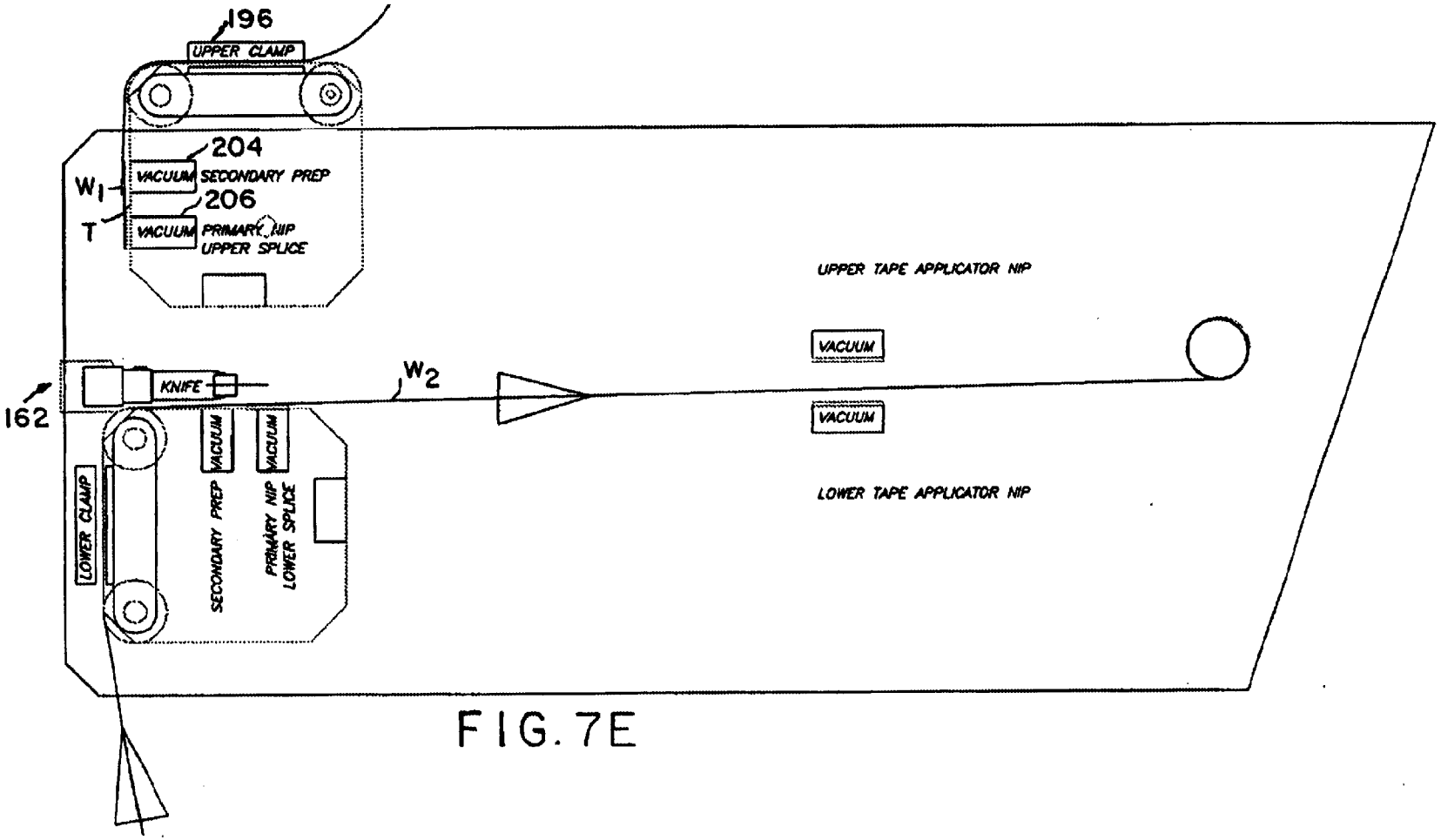

While web is being drawn from the lower roll $R_2$, the leading end of the web $W_1$ on the upper roll $R_1$ is readied for the next splice. For this, the web $W_1$ from the upper roll is pulled down in front of the upper splicing section 156 which is in its normal operating condition as shown in FIG. 6. The leading end of the web $W_1$ is inserted between the anvil 196 and the clamping bar 198 as shown in FIG. 6. Then the operator manually lowers the upper surface drive 130 to fix the position roll $R_1$ and presses a control button 56*a* on controller 56 which causes the cylinder 202 to advance the clamping bar 198 so that the web $W_1$ is clamped between that bar anvil 196 as shown in FIG. 7A. Unless done manually, the controller thereupon actuates the rotary actuator 174 to rotate the upper splicing section 156 clockwise 90° to its open, web preparation position shown in FIG. 7B such that leading end segment of the web $W_1$ drapes down in front of preparation bar 204 and splicing bar 206 of splicing section 156 as seen in that figure. Next, with the splicing head 156 in its open position, the operator cuts or trims the web $W_1$ to give the web $W_1$ a straight, clean leading edge. If a butt splice is desired, the web is cut at the lower edge of the preparation bar 204 as shown in FIG. 7C. To produce a lap splice, the cut is made at the upper edge of the splicing bar 206. Next, as shown in FIG. 7D, operator lifts the leading end of web $W_1$ and places a strip of tape T over the perforate surfaces of both bars 204 and 206, adhesive side out, the tape being as long as the web is wide and held in place by vacuums drawn at those surfaces. The leading end of web $W_1$ thereupon lays down against the upper segment of the tape as shown in FIG. 7E.

Figure 7F:
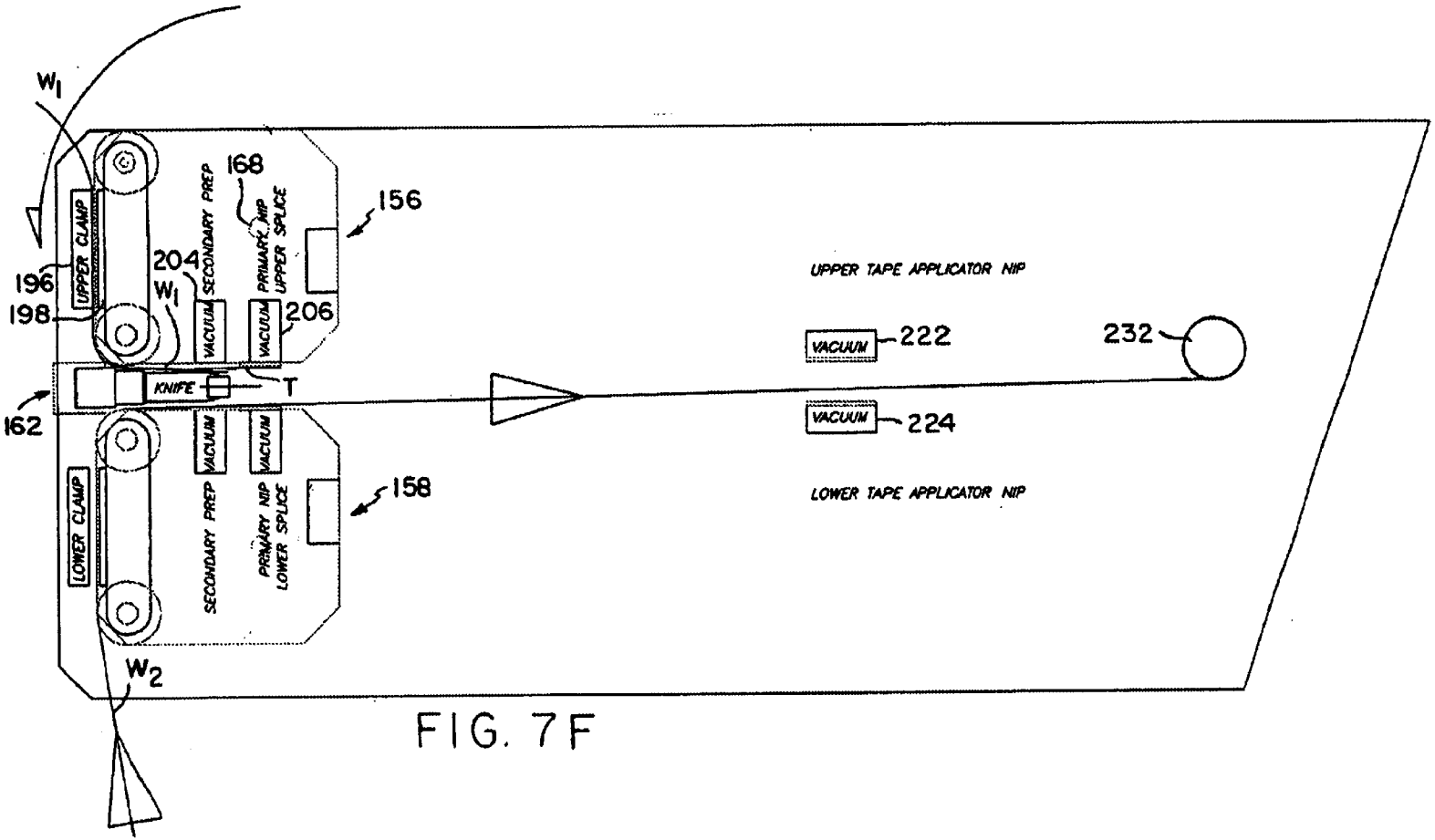

Unless done automatically, the operator may then press a control button on controller 56 which causes the actuator 174 to rotate the upper splicing section 156 counterclockwise 90° to its closed, operative position as shown in FIG. 7F. The movement of the splicing section 156 to its closed position remove any slack in the web $W_1$ between that splicing section and the roll $R_1$ caused by the previous opening of that section. At this point, the tape T is still sucked against the bars 204 and 206 and the leading end segment of the web $W_1$ is adhered to the portion of the tape T covering bar 204, the remainder of the tape being exposed as shown in FIG. 7F.

Figure 7G:
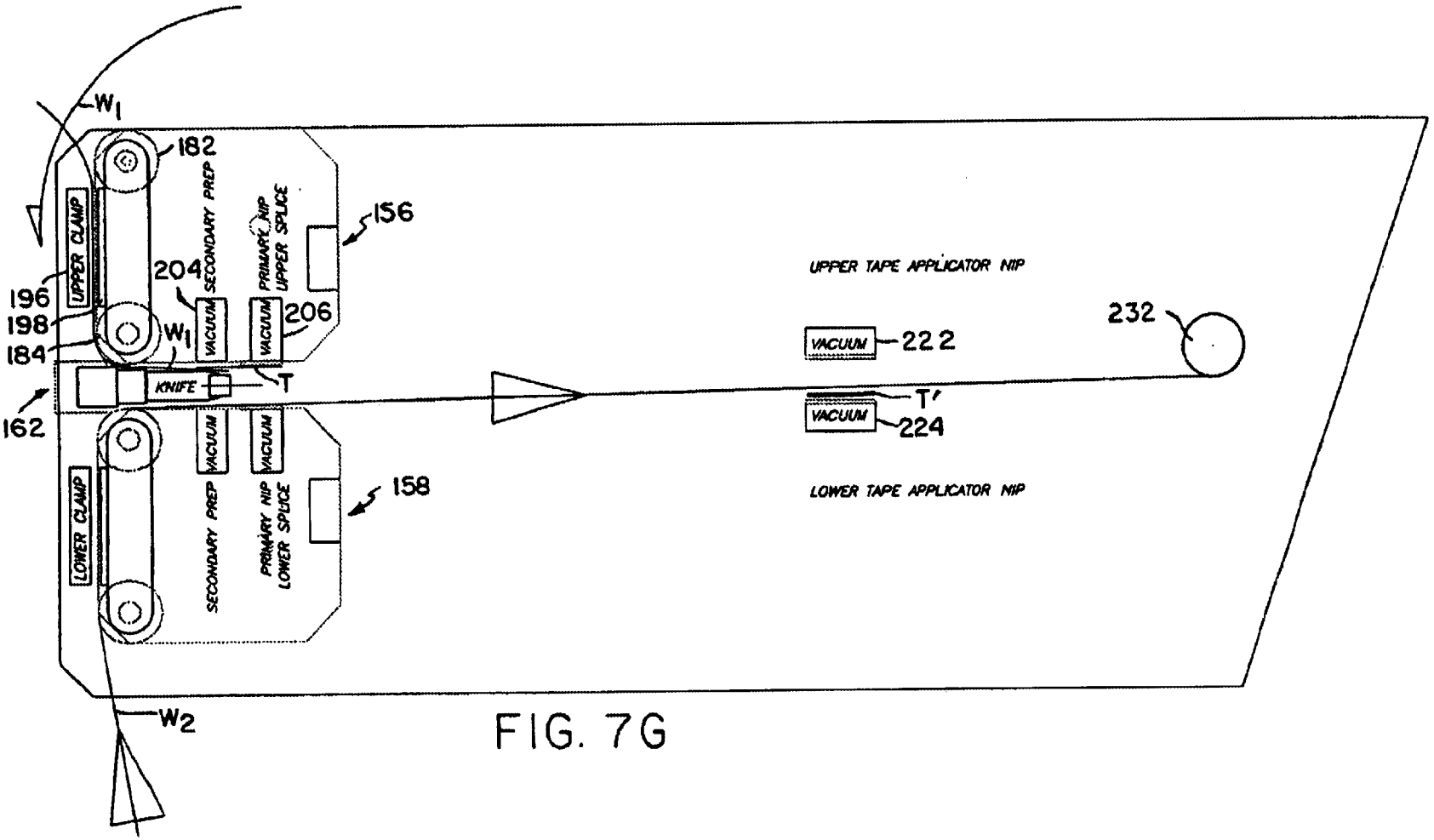

After the splicing section 156 has moved to its closed position, the controller 56 controls cylinder 202 to retract the clamping bar 198 as shown in FIG. 7G, thereby releasing web $W_1$ in preparation for the next splice.

If a two sided splice is desired for the webs being joined, the operator slides the nip unit 231 out of the splicing head 64 and secures a second tape T' to the lower nip roll 224, the tape being held in place as shown in FIG. 7G by the vacuum present at the roll surface.

While the operator is preparing web $W_1$ for splicing as first described, web $W_2$ is being drawn from the lower roll $R_2$. Before the lower roll has expired, a splice sequence is initiated. The splice sequence may be initiated manually by pushing a button 56*a* when the operator sees that the lower roll is about to expire or the splice cycle may be initiated automatically when the expiring roll has reached a predetermined minimum diameter using means well known in the art.

In either event, when the splice sequence is commenced, the controller 56 controls the lower surface drive 132 to brake the running roll $R_2$ to a stop. The controller also actuates cylinder 250 in FIG. 1 to advance the nip bar 248 against anvil 244 to clamp the web $W_2$ at the entrance to the web accumulator 242 to prevent web drawback into the splicer head 64. However, the downstream web-consuming machine continues to draw from the web stored in the accumulator. At the same time, the controller 56 actuates cylinder 208 of the lower splicing section 158 so that the lower splicing bar 206 is advanced to the position shown in FIG. 7H wherein it clamps the now stationary web $W_2$ against the similar retracted mirror-image bar 206 of the upper splicing section 156 to effect the splice.

When the splicer is being used to splice preprinted webs in register, the registration sensor 233 detects indicia printed on the web near the end of the roll and sends registration signals to controller 56 causing the controller to deliver control signals to the operative surface drive, i.e. drive 132. In response, drive 132 rotates roll $R_2$ so as to wind web $W_2$ back up on its core C until that web's preprinted image is in register with the image printed on the ready web $W_1$ when the splice is made. Particularly, when the splicer is used to achieve print registration between the trailing end of the $W_2$ web and the leading end of the web $W_1$, the nip bar 248 is critical to hold the web $W_1$ in register while the splice is made. Without such clamping, the amount of web being drawn back from the accumulator 242 would be indeterminate and could result in registration errors.

Figure 7H:
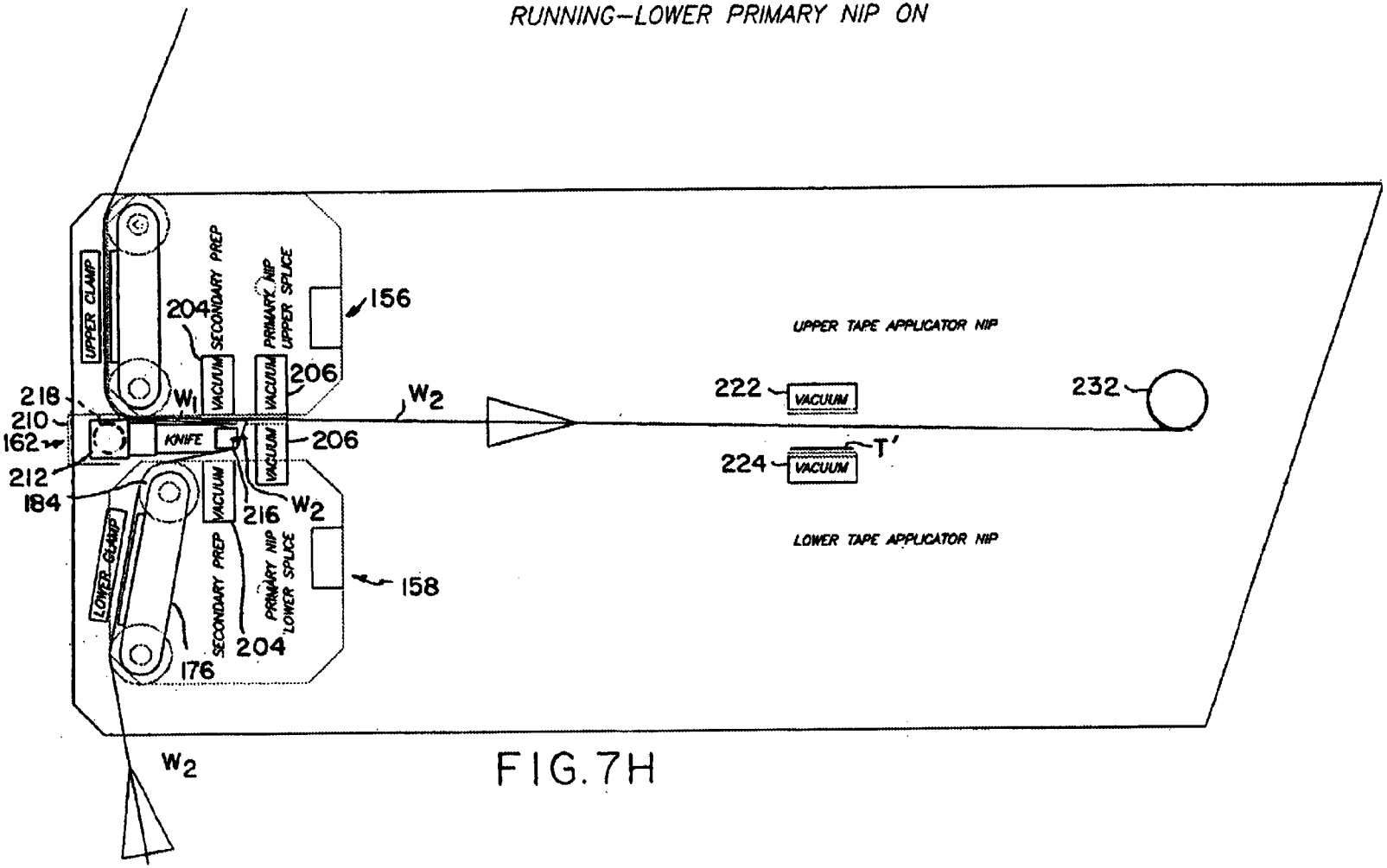

The clamping of the web by the lower splicing bar 206 displaces the web $W_2$ upwards against the upper splicing bar so that a segment of the web is positioned behind the knife assembly 162, and more particularly opposite the cutting edge of one of the blades 216. To accommodate this displacement of the web $W_2$, and to avoid undue tensioning of the web at that location, the controller 56 also actuates the cylinder 192 of the lower housing section 158 so as to swing the bracket 176 of that section clockwise as shown in that figure so that the upper roller 184 mounted to that bracket is shifted rear-wardly to accommodate that web displacement as seen in FIG. 7H.

Figure 7I:
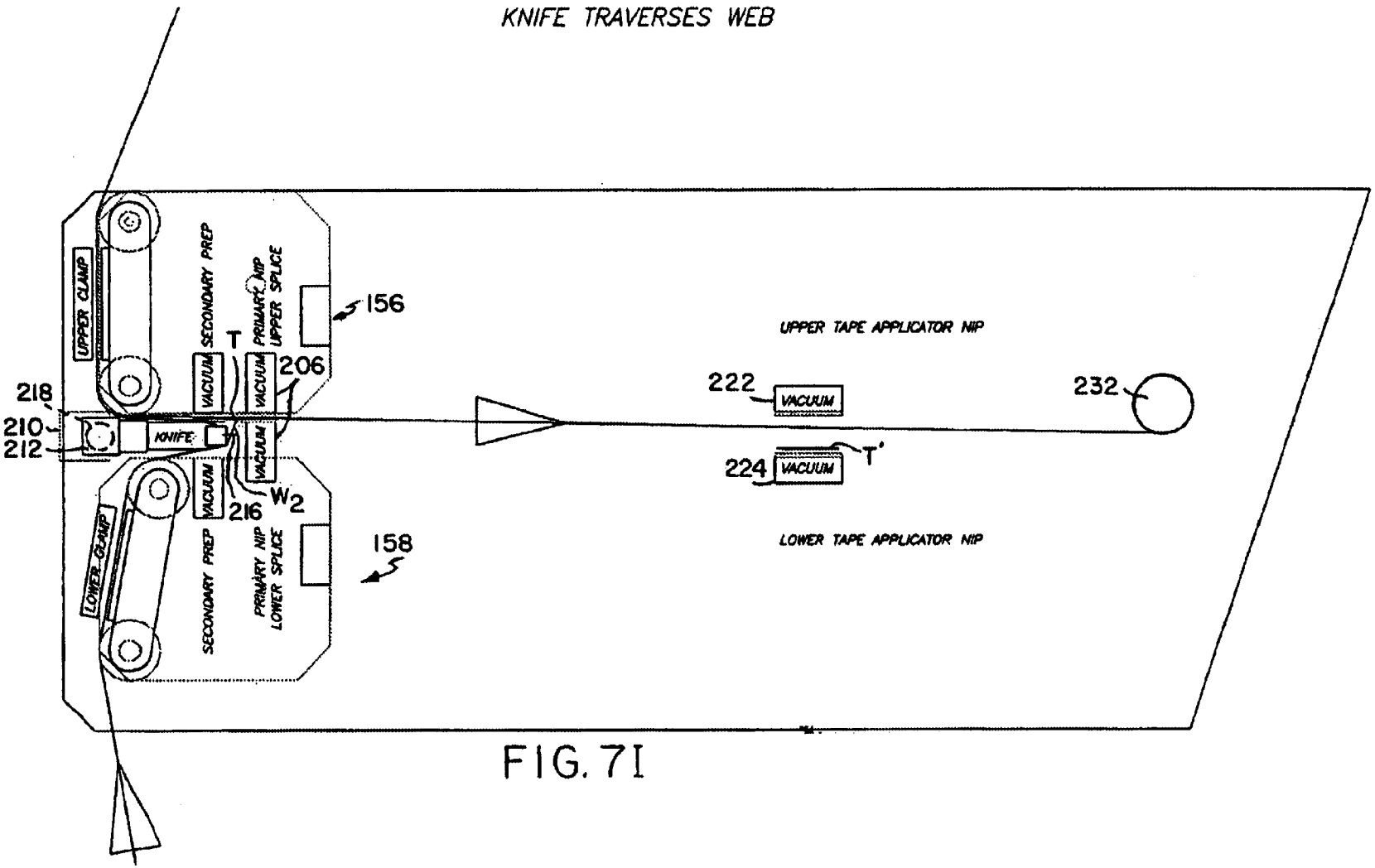

After the web $W_2$ has been clamped as aforesaid, the controller 56 actuates the pneumatic cylinder 218 (FIG. 2) which drives the shuttle 212 along slide 210 in one direction or the other so that the knife blade 216 facing the edge of the web traverses and cuts the web just in front of the splicing bars 206 leaving only a very small tail in front of those splicing bars which fits exactly, and lays down on, the portion of tape T that is not covered by the prepared leading end of web $W_1$ as seen in FIG. 7I. This creates a perfect butt splice between the two webs. If the ready web had been prepared for a lap splice as described above, the web $W_2$ would overlap web $W_1$ on tape T.

Figure 7J:
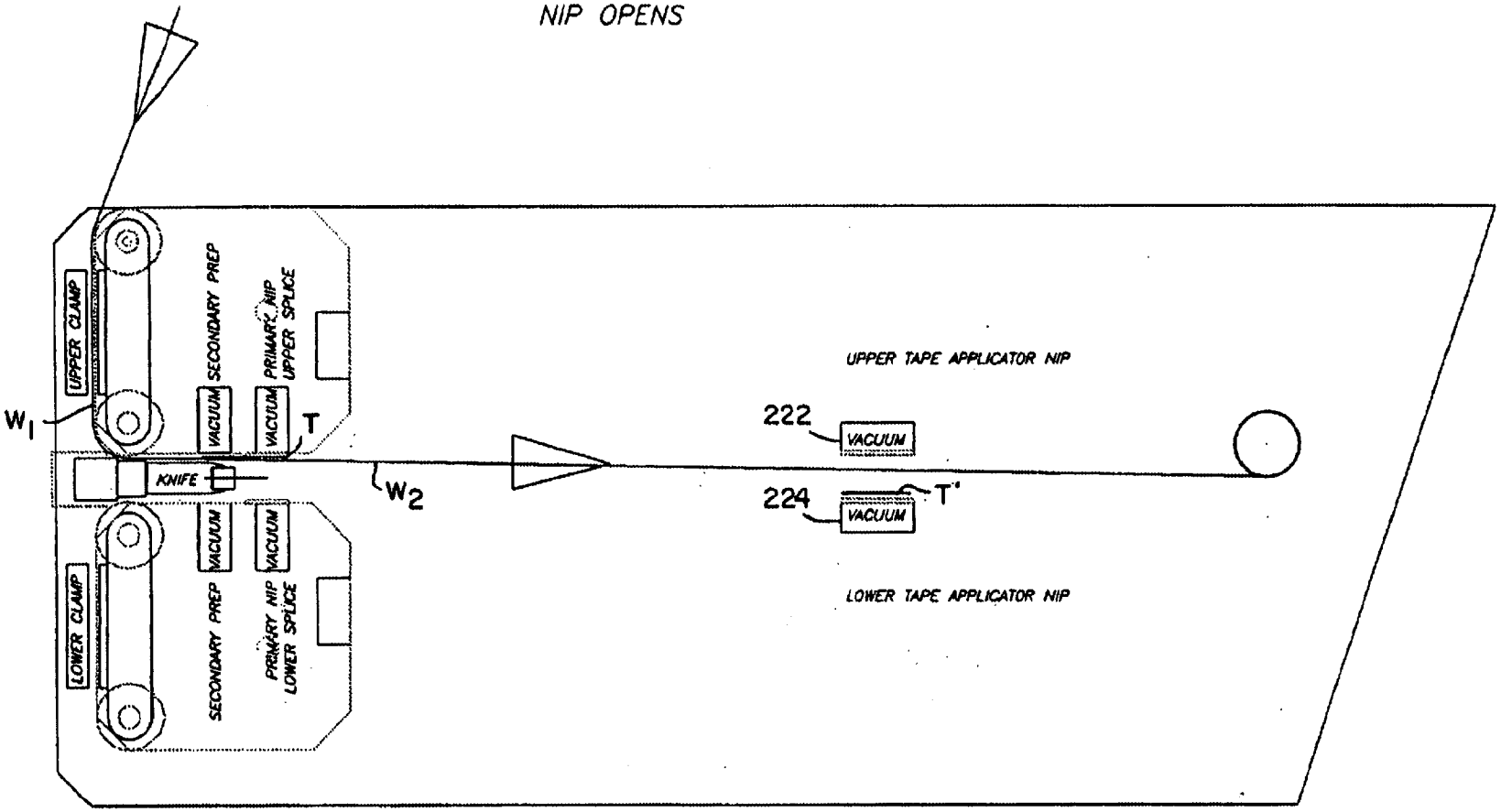
Figure 7K:
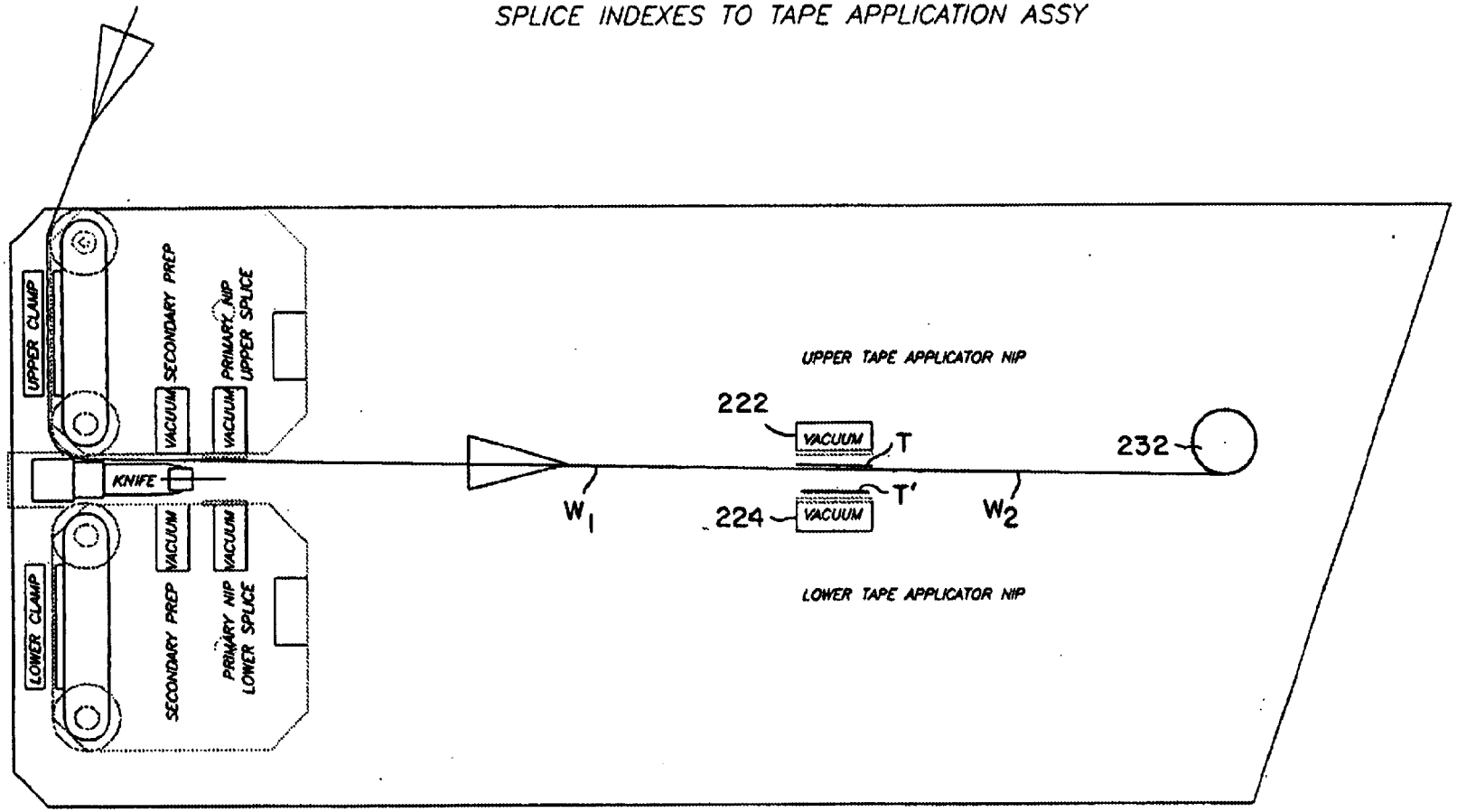

At this point, the controller 56 controls cylinder 208 to retract the clamping bar 206 of the lower splicing section 158 and also actuates cylinder 192 of that section to swing the lower bracket 176 and its roller 184 to the normal upright position as shown in FIGS. 6 and 7J.

Figure 7L:
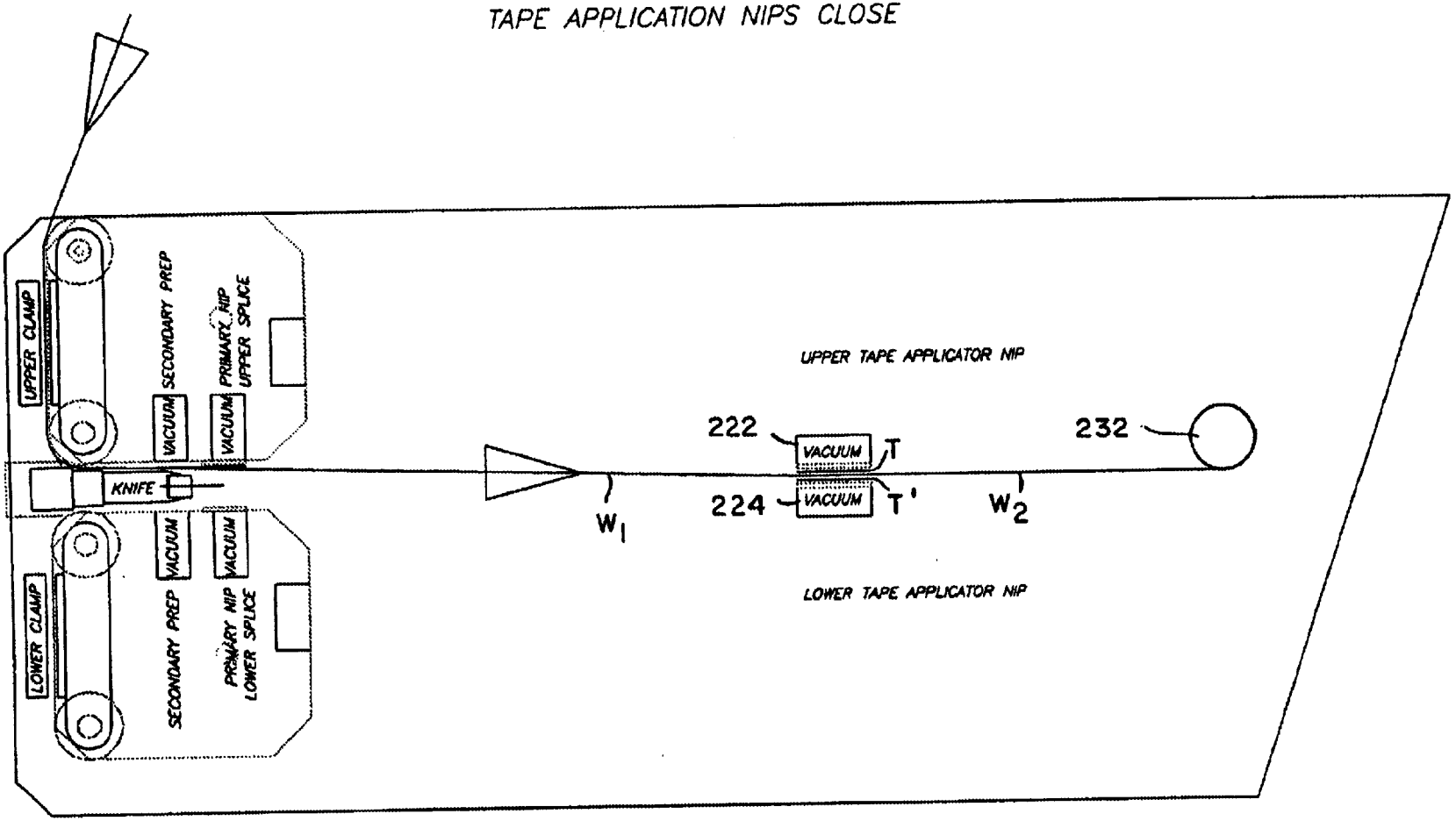
Figure 7M:
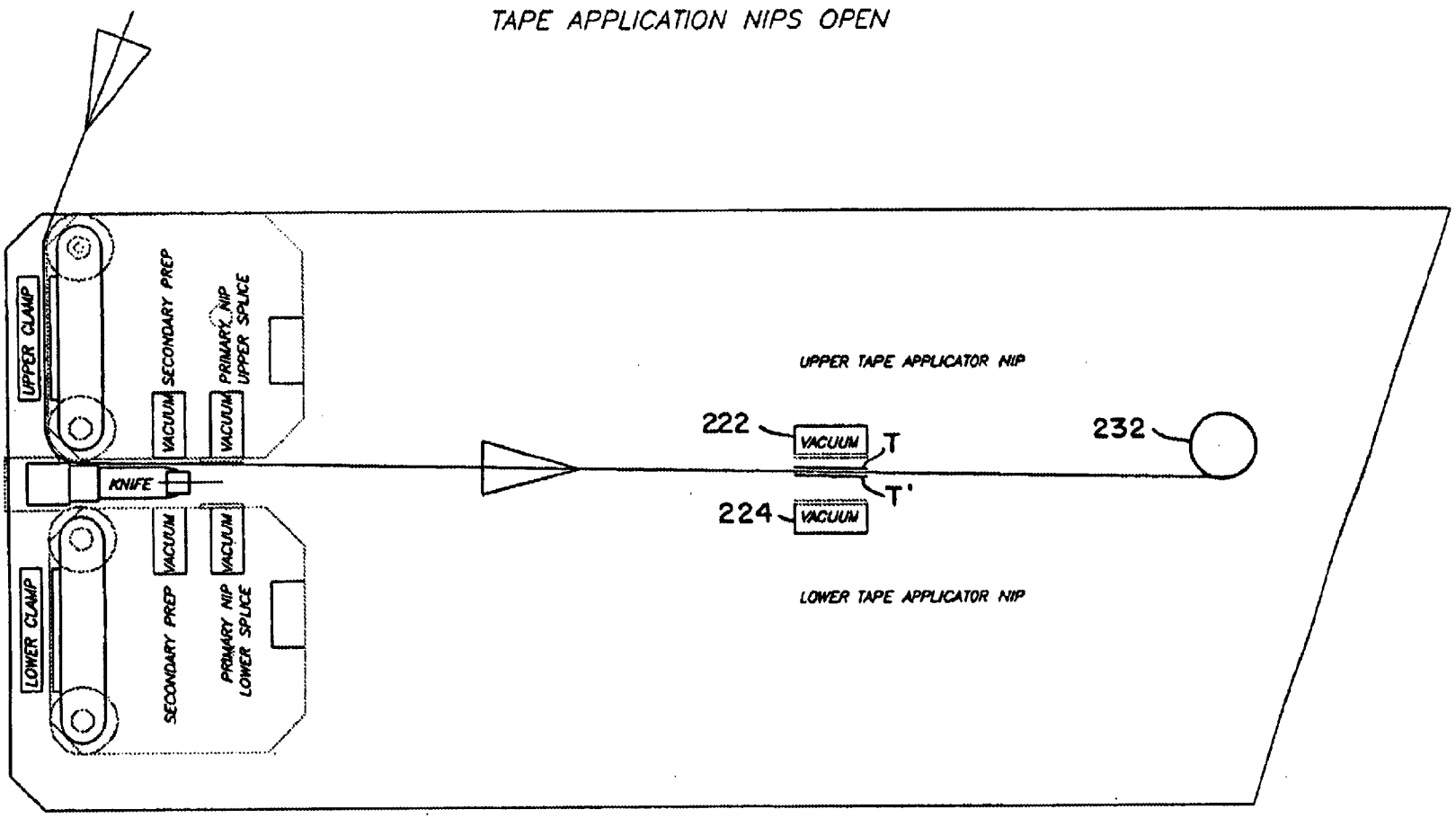

The operator may now press a control button on controller 56 causing the controller to actuate cylinder 250 (FIG. 1) to retract nip bar 248 and also activate the upper surface drive 130 to rotate the upper roll $R_1$ so that the web feeds into accumulator 242 from splicer head 64 due to the downward bias on the dancer 258. Just when the web splice and tape T reach the nip unit 231, the controller momentarily activates actuators 228 and 230 thereby pressing the moving webs $W_1$ and $W_2$ and tape T between the nip rollers 222 and 224 thereby firmly adhering the tape T to the webs as shown in FIG. 7L. Assuming that a second tape T' was applied to the lower nip roller as shown in FIG. 7G, that tape would also be adhered to the opposite sides of the two webs producing a two-sided splice as seen in FIGS. 7L and 7M.

Thus, web is now drawn from the upper roll $R_1$ to suit the requirements of the web consuming machine. As the web is being drawn from the upper roll, the operator may latch the lower surface drive 132 in its upper position shown in phantom in FIG. 1 and swing the lower unwind shaft 62 to its loading position. After removing the clamp 90*b* from that shaft, the expired roll $R_2$, i.e. its core C, may be removed from that shaft and replaced by a new roll. After the clamp 90*b* is again secured to that shaft, the shaft may be swung to its closed position shown in FIGS. 1 and 2 and its leading end prepared as described above to await the next splice sequence which will take place when the upper roll $R_1$ is about to expire. The sequence of steps required to prepare the lower web $W_2$ is exactly the same as described above for the web $W_1$. During the next splice sequence, the leading end of the web from the new lower roll on shaft 62 is spliced to the trailing end of the web $W_1$ from the upper roll $R_1$ so that there is a continuous supply of web to feed the downstream web consuming machine.

As described above, each time a new roll is loaded into the splicer, there is a minimal requirement for a side lay adjustment because the new roll is maintained at a fixed position on its non-rotatable unwind shaft 58 or 62 and the entire splicer frame 10 including the accumulator 240 is automatically shifted laterally as needed to minimize the side lay of the web leaving the splicer with respect to the centerline of the downstream web consuming machine. It is also apparent that the present splicer is very user friendly. The unwind shafts can swing out so that new rolls can be loaded into the splicer quite easily particularly when the lifting device 96 is provided for lifting the upper roll. The splicing head 64 is designed so that all of the steps required in order to prepare the leading end of the ready web can be performed right at the front of the machine without having to reach into any congested areas of the splicer. During splicing, the relative position of the two webs is carefully controlled by the splicer head 64 so that the two webs are brought together to produce a substantially perfect butt (or lap) splice.

It will thus be seen that the objects set forth above among those made apparent from the preceding description are efficiently attained. Also, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A web handling apparatus comprising abase;

a housing;

a splicing head mounted in the housing;

first and second roll shafts, each shaft having opposite first and second ends;

connecting means connecting the roll shafts in the housing substantially parallel to the splicing head so that web can travel through the splicing head to or from web rolls or the roll shafts;

a web accumulator mounted to the housing for conducting web to or from the splicing head;

mounting means for movably mounting the housing to the base so that the housing can move relative to the base in either direction parallel to the roll shafts;

moving means connected between the housing and the bas for moving the housing and accumulator together relative to the base, and control means for controlling the moving means while web is travelling through the splicing head so that the travelling web is maintained in alignment with a downstream machine centerline.

2. The web handling apparatus defined in claim 1 wherein the moving means include an actuator; and further including a web position sensor for sensing the lateral position of web entering or leaving the accumulator and producing a position signal in response thereto, and a controller responsive to the position signal for comparing the lateral position of a web conducted to or from a roll on one of the roll shafts with respect to a desired web position and producing a difference signal in response to the comparison, said difference signal being applied to the actuator where thereupon moves said housing as needed to minimize the difference.

3. The web handling apparatus defined in claim 2 wherein the actuator is a lead screw-type actuator.

4. The web handling apparatus defined in claim 2 wherein the mounting means comprise a plurality of upwardly facing, low coefficient of friction slide members mounted on the base, and a plurality of sliders extending parallel to said shafts at the bottom of the housing, each slider being slidably received in at least two of said plurality of slides.

5. The web handling apparatus defined in claim 4 wherein each slide comprises a plastic slide member having an upwardly facing channel, and each slider comprises a beam having a lower portion seated in the channels of at least two of said slide members.

6. The web handling apparatus defined in claim 5 and further including a plurality of locking caps, and a plurality of fasteners for fastening the plurality of locking caps to the plurality of slide members so that the locking caps overlie the portions of the beams seated in the channels of the slide members.

7. The web handling apparatus defined in claim 1 wherein the housing includes first and second side walls spaced opposite one another;

the connecting means include a pivot pivotally connecting the first end of each roll shaft to one of the side walls so that each shaft can be swung between a closed position wherein each roll extends parallel to the splicing head and an open position wherein each shaft extends out in front of the housing to facilitate sliding a web roll onto each shaft, and securing means for releasably securing the second end of each shaft to the other of the side walls when each shaft is in its said closed position.

8. The web handling apparatus defined in claim 7 wherein the securing means include first and second saddles mounted to said other side wall for supporting the second ends of the first and second shafts when said shafts are in their closed positions.

9. The web handling apparatus defined in claim 8 and further including a resilient member on the second end of each shaft which resiliently engages the corresponding saddle when said shaft is in its closed position.

10. The web handling apparatus defined in claim 7 wherein the first shaft is located above the splicing head and the second shaft is located below the splicing head;

the pivot of the first shaft is connected to the one side wall by way of a lifting device which can move the first shaft, when in its open position, between a lower loading position located relatively close to the base and an upper loading position located above the splicing head.

11. The web handling apparatus defined in claim 10 wherein the lifting device comprises an elongated vertical slide member mounted to the one side wall;

a carriage slidable along the slide member and supporting the pivot of the first shaft so that the shaft may be moved parallel to the slide member between said upper and lower loading positions, and a reversible lifting device for moving the carriage up and down the slide member.

12. The web handling apparatus defined in claim 11 wherein the lifting device comprises a pneumatic or hydraulic cylinder;

a piston connected to said carriage and being slidable in said cylinder, and means for conducting fluid under pressure selectively to or from the cylinder on either side of the piston.

13. Web handling apparatus comprising a housing having a bottom and first and second side wall spaced opposite one another;

a splicing head mounted in the housing between said side walls;

a first roll shaft having opposite ends and dimensioned to extend between the side walls a second roll shaft having opposite ends and dimensioned to extend between the side walls first connecting means including a first pivot for pivotally connecting one end of the first shaft to one of the side walls above the splicing head so that the first shaft can be swung between a closed position wherein the first shaft extends parallel to the splicing head and an open portion wherein the first shaft projects out in front of the housing, said first pivot being connected to said one of the side walls by way of a lifting device which can move the first shaft, when in its said open position, between a lower loading position located relating close to the bottom of the housing and upper loading position located above the splicing head;

second connecting means including a second pivot for pivotally connecting one end of the second shaft to one of the side walls below the splicing head so that the second shaft can be swung between a closed position wherein the second shaft extends parallel to the splicing head and an open position wherein the second shaft projects out in front of the housing, and securing means for releasably securing the other end of each shaft to the other of the side walls when each shaft is in its said closed position.

14. The web handling apparatus defined in claim 13 wherein the securing means include first and second saddles mounted to the other side wall for supporting the second ends of the first and second shafts when said shafts are in their closed positions.

15. The web handling apparatus defined in claim 14 and further including a resilient member on the second end of each shaft which resiliently engages the corresponding saddle when said shaft is in its closed position.

16. The web handling apparatus defined in claim 13 wherein the lifting device comprises an elongated vertical slide member mounted to the one side wall;

a carriage slidably along the slide member and supporting the pivot of the first shaft so that the shaft may be moved parallel to the slide member between said upper and lower loading positions, and a reversible lifting device for moving the carriage up and down the slide member.

17. The web handling apparatus defined in claim 16 wherein the lifting device comprises a pneumatic or hydraulic cylinder;

a piston connected to said carriage and being slidable in said cylinder, and means for conducting fluid under pressure selectively to or from the cylinder on either side of the piston.

18. Web handling apparatus comprising a housing having first and second side walls spaced opposite each other;

a splicing head supported horizontally between the side walls, said splicing head including a horizontally travelling knife;

an upper roll shaft supported horizontally between the side walls above the splicing head;

a lower roll shaft supported horizontally between the side walls below the splicing head;

an upper surface drive mounted between the side walls above the upper roll shaft for engaging a first web roll on the upper roll shaft;

a lower surface drive mounted between the side walls above the lower roll shaft for engaging a second web roll on the lower roll shaft;

a web accumulator mounted to the housing behind the splicing head for storing a supply of web conducted to or from the splicing head;

a registration sensor for sensing indicia on web located between the splicing head and the accumulator and producing a corresponding registration signal, and control means responsive to said signal for controlling the upper or lower surface drive so as to rotate the web roll associated with the web being sensed so as to rewind web onto that roll until that web is brought into registration with the web from the other roll at the splicing head.

19. The web handling apparatus defined in claim 18 wherein each surface device includes an endless belt which engages the perimeter of the underlying web roll.

20. The web handling apparatus defined in claim 18 and further including clamping means in the housing between the splicing head and the accumulator for clamping the web being sensed to prevent web drawback from the accumulator.

21. The web handling apparatus defined in claim 18 wherein the splicing head comprises upper and lower minor image splicing sections position above and below the knife, each section including an elongated horizontal web preparation bar and an elongated horizontal splicing bar spaced beside the preparation bar;

mounting means for pivotally mounting each splicing section to the side walls so that each section can rotate about a horizontal axis between a slicing position wherein said bars of that section face the other section and a web preparation position wherein the bars of that section face away from the accumulator, each of said clamping bars having a clamping surface an being movable between a retracted position wherein its clamping surface is co-planar with the preparation bar of that splicing section and an extended position wherein its clamping surface exerts pressure on the clamping surface of the clamping bar in the other splicing section when both splicing sections are in their splicing positions, and actuating means for moving each clamping bar between its said two positions.

22. The web handling apparatus defined in claim 21 and further including stops for establishing the two positions of each splicing section.

23. The web handling apparatus defined in claim 21 and further including moving means for rotating each splicing section between its said two positions.

24. The web handling apparatus defined in claim 21 wherein each splicing section also includes an elongated horizontal web clamp that faces away from the other splicing section when said each section is in its web preparation position, and an actuator for actuating said clamp.

25. The web handling apparatus defined in claim 21 wherein the splicing head also includes a pair of nip rollers mounted between the housing side walls behind the splicing sections, said nip rollers being movable into and out of contact with each other, and means for moving the nip rollers toward and away from each other.

26. The web handling apparatus defined in claim 25 wherein the nip rollers are vacuum rollers.

27. The web handling apparatus defined in claim 21 wherein said bars are vacuum bars.

28. The web handling apparatus defined in claim 21 wherein each splicing section also includes a pair of spaced-apart upper and lower horizontal rollers swingably mounted to that splicing section so that the roller closer to the knife can moved between a forward position spaced in front of the preparation bar of that splicing section and a rearward position closer to preparation bar of that splicing section, and an actuator for moving the rollers between said positions.

29. The web handling apparatus defined in claim 28 wherein the upper and lower rollers of each splicing section are rotatably mounted to swingable brackets;

an elongated web clamp is mounted to the brackets between the rollers, and an actuator is mounted to that splicing section for swinging the brackets.

* * * * *

UNITED STATES PATENT AND TRADEMARK OFFICE

CERTIFICATE OF CORRECTION

PATENT NO. : 6,817,566 B2
DATED : November 16, 2004
INVENTOR(S) : John W. Clifford et al.

It is certified that error appears in the above-identified patent and that said Letters Patent is hereby corrected as shown below:

Column 11,
Line 12, “remove” should be -- removes --.

Column 13,
Line 26, “abase” should be -- a base --;
Line 35, “or” should be -- on --; and
Line 41, “bas” should be -- base --.
Line 59, “where” should be -- which --.

Column 16,
Line 32, “minor” should be -- mirror --;
Line 39, “slicing” should be -- splicing --; and
Line 43, “an” should be -- and --.

Column 18,
Line 2, “to” should read -- to the --.

Signed and Sealed this

Twenty-sixth Day of April, 2005

JON W. DUDAS
*Director of the United States Patent and Trademark Office*